US009610764B2

(12) United States Patent
Thayer et al.

(10) Patent No.: US 9,610,764 B2
(45) Date of Patent: Apr. 4, 2017

(54) SYSTEM AND METHOD FOR IMAGING IN AN AQUEOUS INKJET PRINTER

(71) Applicant: Xerox Corporation, Norwalk, CT (US)

(72) Inventors: Bruce E. Thayer, Spencerport, NY (US); Linn C. Hoover, Webster, NY (US); Robert A. Clark, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/053,420

(22) Filed: Feb. 25, 2016

(65) Prior Publication Data

US 2016/0167381 A1 Jun. 16, 2016

Related U.S. Application Data

(62) Division of application No. 14/562,895, filed on Dec. 8, 2014, now Pat. No. 9,321,268.

(51) Int. Cl.
*B41J 2/01* (2006.01)
*B41J 2/005* (2006.01)

(52) U.S. Cl.
CPC ..... *B41J 2/01* (2013.01); *B41J 2/0057* (2013.01); *B41J 2002/012* (2013.01)

(58) Field of Classification Search
None
See application file for complete search history.

(56) References Cited

U.S. PATENT DOCUMENTS

| | | | | |
|---|---|---|---|---|
| 4,538,156 | A | 8/1985 | Durkee et al. | |
| 5,389,958 | A | 2/1995 | Bui et al. | |
| 6,148,162 | A * | 11/2000 | Huston | B41J 11/46 399/389 |
| 6,684,048 | B2 | 1/2004 | Caruthers et al. | |
| 8,220,917 | B2 | 7/2012 | Taniuchi et al. | |
| 2011/0279516 | A1 | 11/2011 | Hu et al. | |
| 2014/0146115 | A1* | 5/2014 | Frazier | B41J 2/0057 347/88 |
| 2014/0168304 | A1 | 6/2014 | Mizes et al. | |

FOREIGN PATENT DOCUMENTS

JP EP 2939842 A1 * 11/2015 ..... B41J 2/0057

* cited by examiner

*Primary Examiner* — Lisa M Solomon
(74) *Attorney, Agent, or Firm* — Maginot Moore & Beck LLP

(57) ABSTRACT

A printer includes a surface preparatory material remover. The remover is configured with a pad mounted to a roller to engage selectively the surface preparatory material on a surface of a rotating member to remove a portion of the surface preparatory material outside of an area where an ink image is formed to reduce the adhesion of media to the rotating member surface as the media exits a nip in which the ink image is transferred to the media.

20 Claims, 26 Drawing Sheets

SYSTEM AND METHOD FOR IMAGING IN AN AQUEOUS INKJET PRINTER

PRIORITY CLAIM

This application is a divisional of and claims priority to U.S. patent application Ser. No. 14/562,895, which is entitled "System And Method For Imaging In An Aqueous Inkjet Printer" that was filed on Dec. 8, 2014, and which issued as U.S. Pat. No. 9,321,268 on Apr. 26, 2016.

TECHNICAL FIELD

This disclosure relates generally to indirect inkjet imaging systems, and more particularly, to systems that provide reliable imaging for aqueous inkjet printing.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. To address this issue, indirect printers have been developed that eject ink onto a blanket mounted to a drum or endless belt. The ink is dried on the blanket and then transferred to media. Such a printer avoids the changes in media properties that occur in response to media contact with the water or solvents in aqueous ink. Indirect printers also reduce the effect of variations in other media properties that arise from the use of widely disparate types of paper and films used to hold the final ink images.

In these indirect printers, the blanket surface must wet well enough to prevent significant coalescence of the ink on the surface and also facilitate the release of the ink from the blanket to the media after the ink has dried on the blanket. Applying a coating material to the blanket can facilitate the wetting of the blanket surface and the release of the ink image from the blanket surface. Coating materials have a variety of purposes such as wetting the blanket surface, inducing solids to precipitate out of the liquid ink, providing a solid matrix for the colorant in the ink, aiding in the release of the printed image from the blanket surface, or the like. In certain systems both the coating material and the layers of ink on the blanket surface can adhere to the media on which the printed image has been transferred from the blanket surface. Because the coating material and the layers of ink can be prone to high adhesion, image defects can arise from unreliably stripping of the media from the blanket surface. Image defects can degrade the final image quality. Reliable methods of stripping the media from the blanket surface would be beneficial.

In previously known indirect printers, air knives have been used to enable stripping of the media from the blanket surface. However, in printers with an insufficient lead edge separation of the media from the blanket surface, air knives may not reliably strip the media from the blanket surface because adhesion of the media to the blanket surface can be high. Certain previously known printers use stripper fingers to enable stripping of the media from the blanket surface.

However, stripper fingers may prove unreliable because the lead edge of the media may have little or no separation from the blanket surface. Consequently, pressure may be needed to press the stripper fingers onto the blanket surface to urge the fingers between the blanket and media; however, these pressures may cause the fingers to affect the blanket surface adversely and shorten the life to the blanket. Certain previously known printers use small bend radii to enhance separation of the media from transfer surfaces or fusing surfaces. However, some printers have too large of a radius to encourage self-stripping. In other printers, such as printers with a belt architecture, the bending of the blanket belt around a small radius can lead to issues such as belt cracking and fatigue failure. Improvements in aqueous indirect inkjet printers that enable more reliable stripping of the media from the blanket surface are desirable.

SUMMARY

In order to address this need, a printer has been configured to enable the stripping of a media from the surface of a rotating member. The printer includes a printhead configured to eject liquid ink towards the surface of a rotating member, which rotates past the printhead. The printer further includes an applicator that applies a surface preparatory material to the surface of the rotating member and enables the ink ejected by the printhead to form an ink image on the surface preparatory material. The printer further includes a first pad that removes a portion of the surface preparatory material from the surface of the rotating member. The printer further includes a controller that is operatively connected to the printhead and the first pad. The controller is configured to operate the printhead to form the ink image on the surface preparatory material and operate the first pad to remove the portion of surface preparatory material that is within an area in which the ink image is not located.

In one aspect, the controller is further configured to receive an electrical signal identifying the type of media to which the ink image is to be transferred and to operate the first pad to remove the surface preparatory material with reference to the electrical signal. In another aspect, the printer can further include a first roller configured to remove the surface preparatory material from the first pad.

A new method of printer operation that enables stripping of a media from the surface of a rotating member. The method includes applying with a first roller a surface preparatory material to a surface of a rotating member. The method further includes operating a printhead with a controller to eject ink onto the surface preparatory material and form an ink image on the surface preparatory material. The method further includes operating a first pad with the controller to engage selectively the surface preparatory material and remove a portion of the surface preparatory material that is within an area in which the ink image is not located.

BRIEF DESCRIPTION OF THE DRAWINGS

The foregoing aspects and other features of an inkjet printer that enables the stripping of the media are explained in the following description, taken in connection with the accompanying drawings.

DETAILED DESCRIPTION

Figure 1:
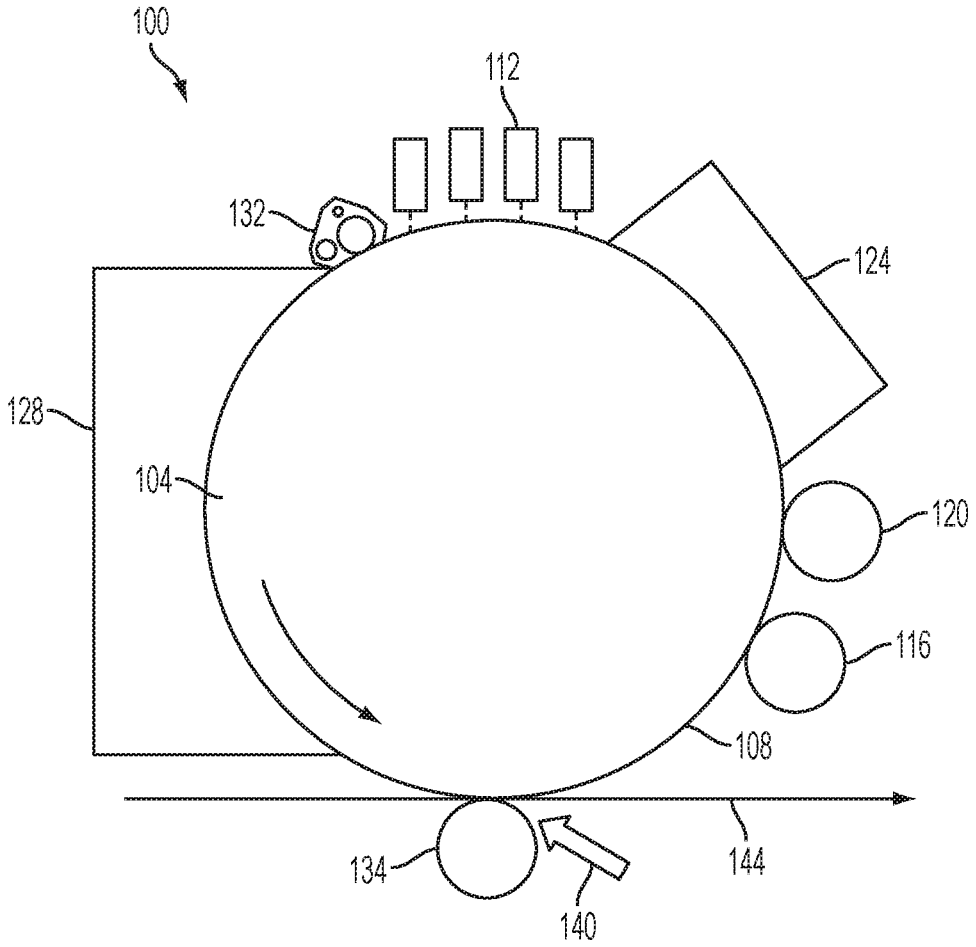
FIG. 1 illustrates an exemplary embodiment of a printer configured to strip media from a blanket mounted about a rotating member in accordance with the disclosed subject matter.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and configured to operate the inkjet ejectors to form an ink image on the print media. These data can include text, graphics, pictures, and the like. The operation of producing images with colorants on print media, for example, graphics, text, photographs, and the like, is generally referred to herein as printing or marking. As used in this document, the term "aqueous ink" includes liquid inks in which colorant is in solution with water and/or one or more solvents.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface. As used in this document, a "rotating member" includes a drum, an endless belt, an image blanket drum or the like on which the blanket or an image blanket is mounted. As such, the "image receiving surface" refers to the blanket, the surface of the blanket that is mounted on the rotating member, the surface of a surface preparatory material on the blanket, the surface of the media, the surface of the rotating member if no blanket is used, or the like. As used herein, the "material" or a "surface preparatory material" refers to a coating material, a skin, or the like that is applied on the surface of the blanket. The surface preparatory material facilitates the wetting of the blanket and the release of the ink image from the blanket.

FIG. 1 illustrates an exemplary embodiment of a printer 100 configured to strip media 144 from a blanket 108 mounted about a rotating member 104. In an exemplary embodiment, the printer 100 includes a rotating member 104, a blanket 108, a printhead assembly 112, a cleaning apparatus 116, an applicator 120, a first dryer 124, a surface material removal apparatus 132, an ink dryer 128, and a transfer roller 134. The rotating member 104 can be provided in the form of a drum, an endless belt, or the like. A blanket 108 is mounted about the rotating member 104 to provide favorable surface conditions for the printing of aqueous ink. After a print cycle, residual ink and other debris is removed from the blanket 108 by the cleaning apparatus 116 and new surface preparatory material is applied to the cleaned blanket 108 by the applicator 120. The cleaning apparatus 116 can include, but is not limited to, a wiper blade preceded by a moistened pad, a water-lubricated wiper blade, or the like. The surface preparatory material on the blanket 108 can be dried using a first dryer 124. Examples of the first drying apparatus 124 include, but are not limited to, an air flow to evaporate water, solvents, or the like. When the surface preparatory material is dried, it can leave behind a dry and tacky coating or film. Surface preparatory material remover 132 cleans or removes a portion of the preparatory surface preparatory material from the blanket 108 to facilitate the stripping of media 144 from the nip 140 formed between the rotating member 104 and the transfer roller 134 as described in more detail below. Printhead assembly 112 includes one or more inkjet printheads that eject ink onto the blanket 108. Ink dryer 128 dries the ink and the agent applied by the material removal apparatus 132 to clean the preparatory surface preparatory material from the blanket in patterns that complement the ink image on the blanket. Examples of the ink dryer 128 include, but are not limited to, infra-red lamps, an air flow source, or the like that evaporates water and/or solvents from the blanket 108. The consistency of the resulting ink on the blanket 108 can be a semi-wet ink consistency. While the printer 100 of FIG. 1 illustrates an exemplary embodiment of positioning the surface preparatory remover 132 before the ink drier 128, the reader should understand that in other exemplary embodiments, the material removal apparatus 132 can be positioned in another area of the printer 100 to remove the surface preparatory material from the blanket 108. Other exemplary embodiments include but are not limited to, positioning the material removal apparatus 132 before the printhead assembly 112 forms the ink image, positioning the material removal apparatus 132 after the ink dryer 128 dries the ink image, or the like.

The material removal apparatus 132 is configured to remove a portion of the surface preparatory material applied to the surface of blanket 108. In one example, water moistened pads are used in the surface preparatory material remover 132 to dissolve and wick away a portion of the surface preparatory material layer in a specified lead-edge location of an image area on the blanket 108. The removal of the surface preparatory material from the blanket 108 enables the lead edge of the image area on the blanket 108 to adhere less strongly to the media 144 than the remaining portion of the media 144 that contacts the surface preparatory material on the blanket 108. This reduction in attraction between the media 144 and the surface preparatory material at the leading edge of the blanket 108 enables a device, such as an air knife, to strip the media 144 from the blanket 108 more easily. Depending on the properties of the media 144, the media 144 may self-strip from the blanket 108 because of the reduction in surface preparatory material at the leading edge of the image area on the blanket 108.

Figure 2:
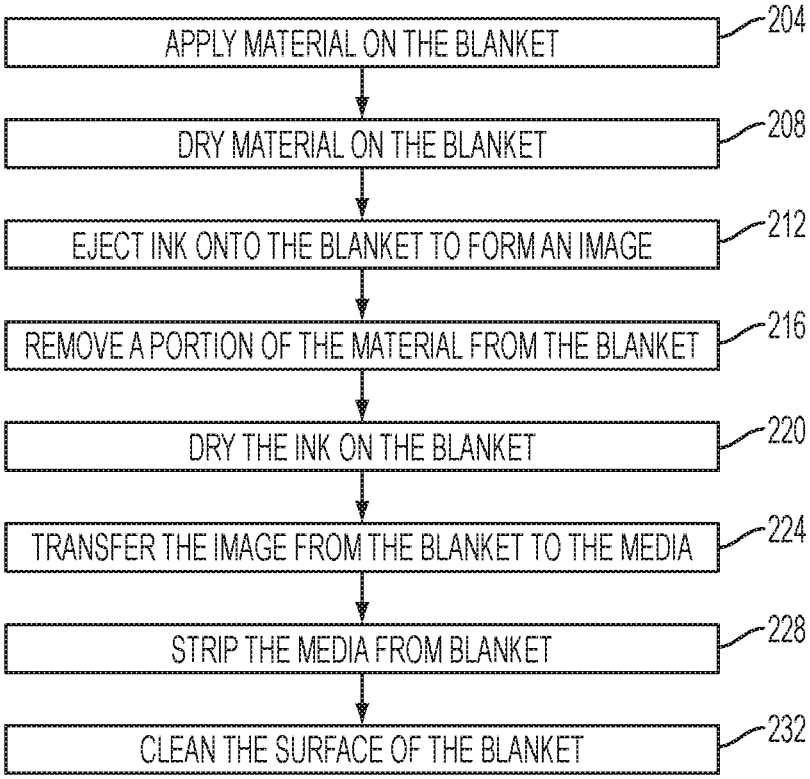
FIG. 2 illustrates an exemplary process for facilitating the stripping of media from a blanket in accordance with the disclosed subject matter.

FIG. 2 illustrates an exemplary process for facilitating the stripping of media 144 from the blanket 108. In an exemplary process, a surface preparatory material is applied to the surface of the blanket 108 using the applicator 120 (Step 204). The surface preparatory material is dried using a first dryer 124 (Step 208). Ink is ejected onto the image area of blanket 108 using a printhead assembly 112 (Step 212). The ejected ink forms a print image on the blanket 108. A portion of the surface preparatory material is removed from the blanket 108 using the material removal apparatus 132 (Step 216). The ink is dried using an ink dryer 128 (Step 220). While the process of FIG. 2 shows the surface preparatory material being removed prior to the ink being dried, the reader should understand that the material removal apparatus 132 can be positioned to remove the surface preparatory material from the blanket 108 before the ink image is formed or after the ink image is dried. The ink can be dried to a semi-wet ink consistency. As the ink image on the blanket 108 reaches the nip 140, media 144 enters the nip so the ink image is transferred from the blanket to the media (Step 224). The leading edge of the media 144 is stripped from the blanket 108 as the media 144 exits the nip 140 (Step 228). The media 144 can either self-strip from the blanket 108 or a device, such as an air knife, directs an air stream into the nip to strip the leading edge of the media 144 from the blanket 108. The surface of blanket 108 is cleaned using the cleaning apparatus 116 (Step 232).

Figure 3:
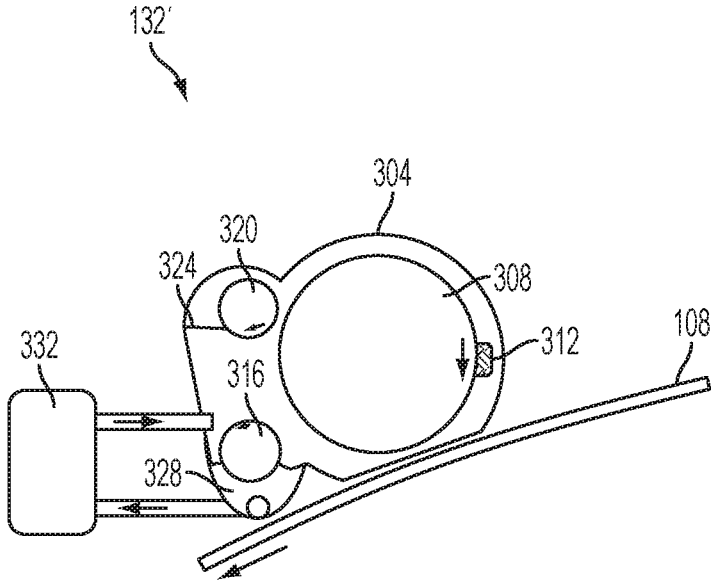
FIG. 3 illustrates an exemplary embodiment of a material removal apparatus in accordance with the disclosed subject matter.

FIG. 3 illustrates an exemplary embodiment of a material removal apparatus 132'. The exemplary material removal apparatus 132' includes a housing 304 which contains a pad support roller 308 having a pad 312, a cleaner roller 316, a sump 328, a fluid removing roller 320, and a wiper 324, which is positioned to engage roller 320. The pad 312 can be a single pad and the materials used for the pad include but are not limited to web, foam, other absorbent materials, or the like. The pad 312 can have well-defined leading and trailing edges. The roller 308 rotates to enable the pad 312 to contact the surface of the blanket 108 and rehydrate and absorb a portion of the surface preparatory material. In another embodiment, the surface preparatory material can be rehydrated with other methods other than a pad 312, such as spraying the surface preparatory material with a misting device or using a moistened substance that can provide an adequate amount of pressure and shear to remove a portion of the preparatory surface preparatory material from the surface of the blanket 108.

The pad support roller 308 is configured with low inertia for fast acceleration. The pad support roller 308 can be driven by an actuator, such as a stepper, servo motor, or the like, which provides high speed and acceleration along with good radial positioning and speed control. The actuator is operatively connected to a controller. The actuator and controller are operatively connected to one another and a component of the preparatory surface material remover 132 for the various embodiments disclosed herein as shown in FIG. 23A, FIG. 23B, FIG. 24A, and FIG. 24B below. The controller operates the actuator to control the pad support roller 308 and pad 312. In one example, the controller receives an electrical signal that identifies the type of media 144 on which the ink image is to be transferred and moves the pad support roller 308 and the pad 312 with reference to the electrical signal.

As the controller operates the actuator to rotate the pad support roller 308, the pad 312 disengages from the blanket 108 and engages the cleaner roller 316. The cleaner roller 316 is configured to apply water to the pad 312 while removing surface preparatory material and other debris from the pad 312. In one example, the cleaner roller 316 rotates in the same direction as the rotation of the pad support roll 308. In another example, the cleaner roller 316 is configured to rotate against the direction of the motion of the pad 312. The debris collects in the sump 328 so that pump 332 can be operated to pass the water through a filter and then be used to rehydrate the roller 316. The pump 332 can be configured with an internal filter, such as a paper, reverse osmosis filter, or the like, to filter the liquid solution stored in sump 328. The filter elements can be replaced as required. Additionally, pump 332 can be coupled to a fluid source to enable water to be added to the sump 328 to maintain a desired liquid level in the sump 328. Fluid removing roller 320 is also rotated to compress the pad 312 and wring excess water from the pad 312. The excess water falls on the cleaner roller 316 or into sump 328. The wiper 324 is positioned to engage the fluid removing roller 320 and strip the water from the surface of the fluid removing 320. The wiper 324 can be made up of plastic, a thin metal strip, or the like.

Figure 4:
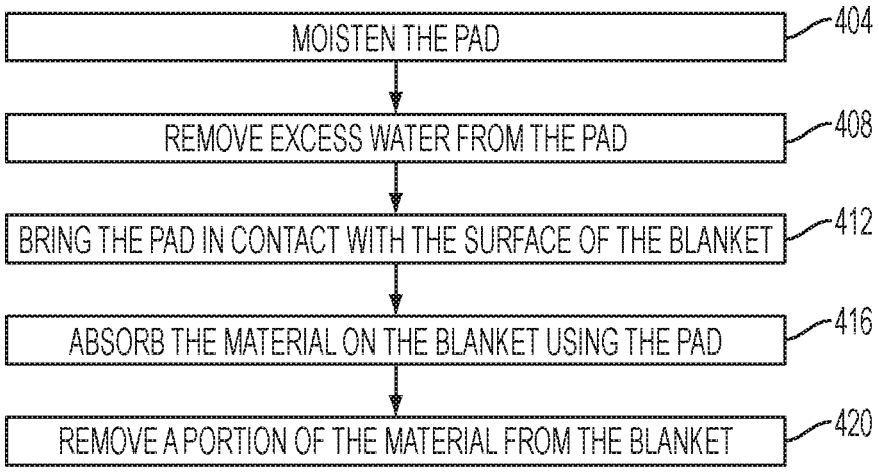
FIG. 4 illustrates an exemplary process of removing a portion of the surface preparatory material from the blanket using the material removal apparatus illustrated in FIG. 3 in accordance with the disclosed subject matter.

FIG. 4 illustrates an exemplary process of removing a portion of the surface preparatory material from the blanket 108 using the material removal apparatus 132' illustrated in FIG. 3. In the exemplary process, the pad 312 is moistened by roller 316 (Step 404). In one example, the pad 312 can be moistened using water. Excess water is then removed from the pad 312 (Step 408) using the fluid removing roller 320 and the wiper 324 removes water from the roller 320. The pad 312 is then brought into contact with the surface of the blanket 108 as the roller 308 rotates in synchronization to engage a leading portion of the ink image area on the blanket 108 (Step 412). When the pad 312 comes in contact with the blanket 108, it rehydrates and absorbs surface preparatory material from the blanket 108 (Step 416). As the roller 308 continues to rotate the pad 312, it loses contact with the blanket 108. Thus, the pad 312 has removed a portion of the surface preparatory material from the blanket 108 (Step 420). Roller 308 then rotates so that the pad 312 contacts the cleaner roller 316 and the cycle can be repeated (Step 404).

Figure 5:
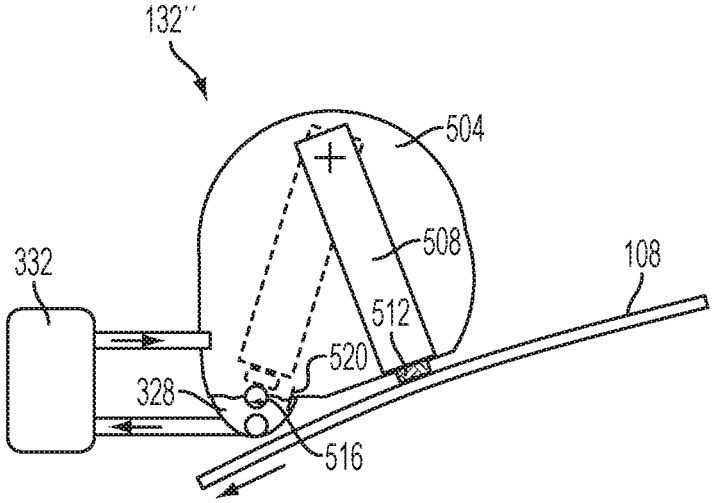
FIG. 5 illustrates another exemplary embodiment of a material removal apparatus in accordance with the disclosed subject matter.

FIG. 5 illustrates another exemplary embodiment of a material removal apparatus 132". The exemplary material removal apparatus 132" includes a housing 504 which contains a pad support arm 508 having a pad 512, a cleaner roller 516, a sump 328, and a wiper 520. The pad support arm 508 is configured with low inertia for fast acceleration. The pad support arm 508 can be driven by an actuator, such as a stepper, servo motor, or the like, which provides a high speed and acceleration along with a good radial positioning and speed control. The actuator is operatively connected to a controller. The controller operates the actuator to control the pad support arm 508. In one example, the controller receives an electrical signal that identifies the type of media 144 on which the ink image on the surface preparatory material is to be transferred and moves the pad support arm 508 with reference to the electrical signal.

As the controller operates the actuator to move or swing the pad support arm 508, the pad 512 disengages from the blanket 108 and engages with the cleaner roller 516. The cleaner roller 516 is configured to apply a liquid solution to the pad 512 while removing surface preparatory material and other debris from the pad 512. Examples of the liquid solution include, but are not limited to water, solvents such as a PVA solution, or the like. The debris collects in the sump 328 so that pump 332 can be operated to pass the liquid solution through a filter and redirected to the roller 516 to rehydrate the roller. The pump 332 can be configured with an internal filter, such as a paper, reverse osmosis filter, or the like, to filter the liquid solution stored in sump 328. The filter elements can be replaced as required. Additionally, pump 332 can be coupled to a fluid source to enable liquid solution to be added to the sump 328 to maintain a desired liquid level in the sump 328.

The wiper 520 is positioned to engage with the pad 512 as it disengages from the cleaner roller 516 and swings towards the blanket 108. The wiper 520 is configured to hit, stop, and compress the pad 512 to expel excess liquid solution from the pad 512 as the pad 512 swings towards the blanket 108. The wiper 520 can be a thin, flexible, polymer film blade that is hinged and lightly spring loaded. A little force can be applied to the wiper 520 as the pad 512 swings towards the blanket 108.

Figure 6A:
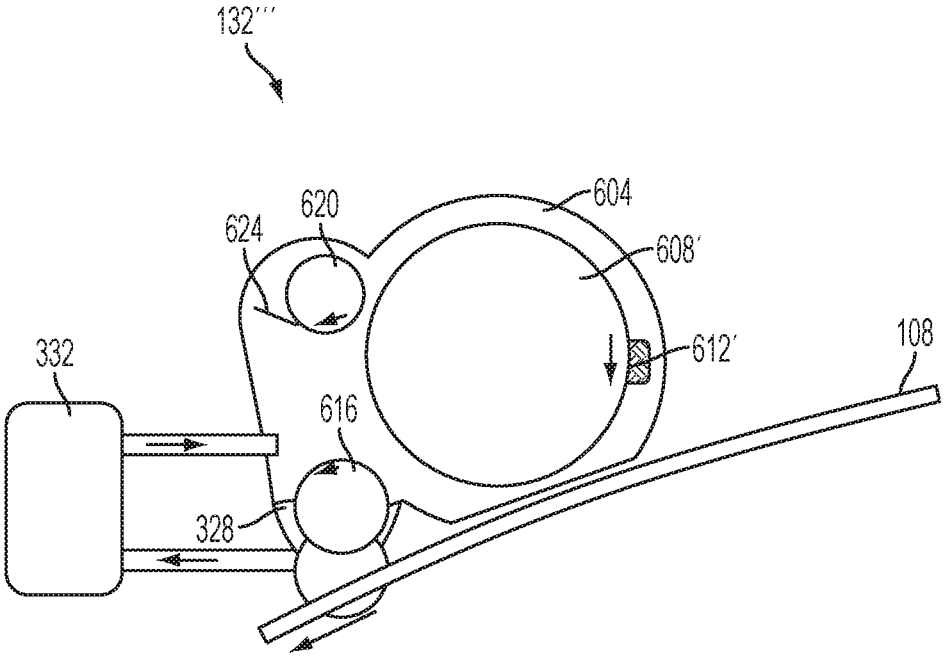
FIG. 6A illustrates another exemplary embodiment of a material removal apparatus in accordance with the disclosed subject matter.
Figure 6B:
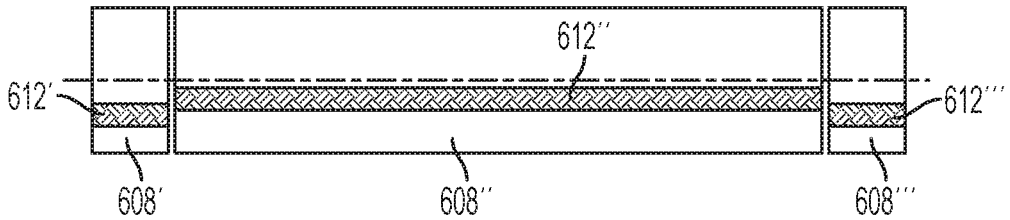
FIG. 6B illustrates an exemplary plurality of segmented pads mounted on pad support rollers in accordance with the disclosed subject matter.

FIG. 6A illustrates another exemplary embodiment of a material removal apparatus 132'". FIG. 6B illustrates the plurality of segmented pads 612', 612", and 612'" mounted on pad support rollers 608', 608", 608'". The exemplary material removal apparatus 132'" includes a housing 604 that contains pad support rollers 608', 608", 608'" to which pads 612', 612", and 612'" are mounted, a cleaner roller 616, and a fluid removing roller 620. The pad 612' on the roller 608' illustrated in FIG. 6A is one segmented pad in a plurality of segmented pads 612', 612", and 612'" depicted in FIG. 6B. The segmented pads 612', 612", and 612'" are mounted on independent pad support rollers 608', 608" and 608'", respectively, so they can be rotated independently of each other. In one example, the rollers 608' and 608'" are rotated together for increased edge margin removal of the surface preparatory material from the blanket 108. The middle roller 608" and pad 612" control the removal of the surface preparatory material from the center portion of the blanket 108.

A controller is operatively connected to one or more actuators and is configured to operate the one or more actuators to rotate the pad support rollers 608', 608" and 608'" independently and move the segmented pads 612', 612" and 612'" in one direction. The pad support rollers 608', 608" and 608'" are rotated to enable the segmented pads 612', 612", and 612'" to vary the positions at which they contact the blanket 108 to rehydrate, absorb, and remove the surface preparatory material from the blanket 108. The segmented pads 612', 612" and 612'" enable the outline of a custom shape of the surface preparatory material to be removed from the blanket 108 instead of a simple rectangular outline of the surface preparatory material.

Figure 7A:
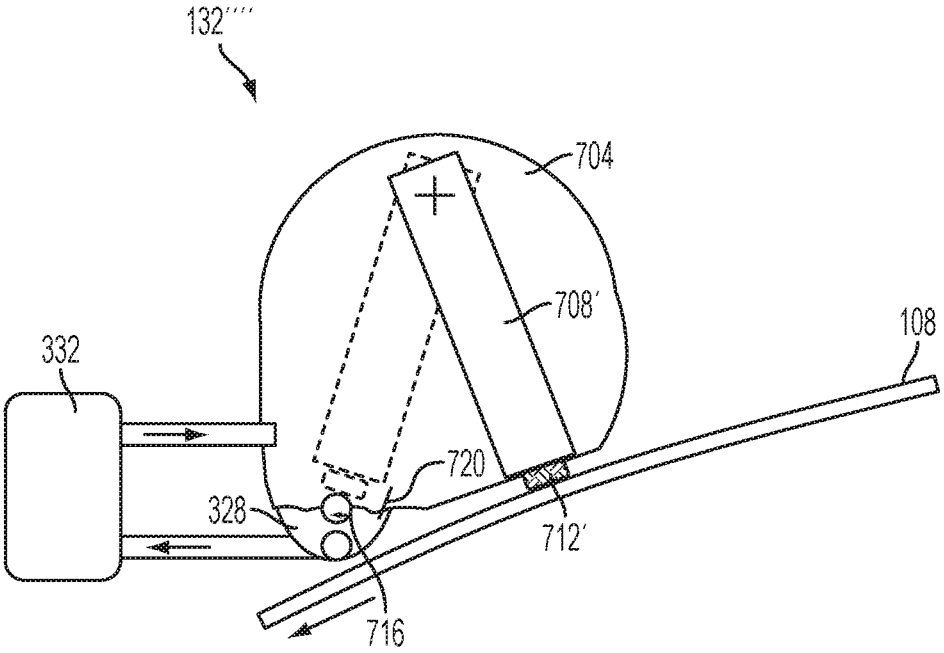
FIG. 7A illustrates another exemplary embodiment of a material removal apparatus in accordance with the disclosed subject matter.
Figure 7B:
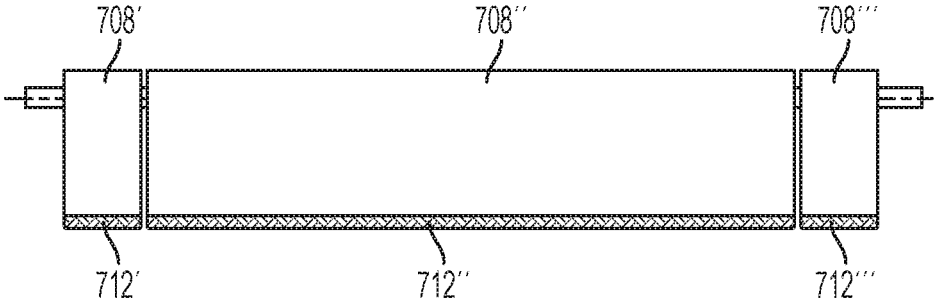
FIG. 7B illustrates another exemplary plurality of segmented pads mounted on pad support arms in accordance with the disclosed subject matter.

FIG. 7A illustrates another exemplary embodiment of a material removal apparatus 132'". FIG. 7B illustrates the plurality of segmented pads 712', 712", 712'" mounted on pad support arms 708', 708", 708'". The exemplary material removal apparatus 132'" includes a housing 704 that contains pad support arms 708', 708", 708' to which pads 712', 712", 712'" are mounted. The exemplary material removal apparatus 132'" further includes a cleaner roller 716, and a wiper 720. The pad 712' on the arm 708' illustrated in FIG. 7A is one segmented pad in a plurality of segmented pads 712', 712", 712'" as depicted in FIG. 7B. The segmented pads 712', 712", 712'" are mounted on independent pad support arms 708', 708", 708'" respectively, so they can be rotated independently of each other. In one example, the pad support arms 708' and 708' are rotated together.

A controller is operatively connected to one or more actuators and is configured to operate the one or more actuators to swing the pad support arms 708', 708" and 708' independently and move the segmented pads 712', 712" and 712' in one direction. The pad support arms 708', 708" and 708' are swung to enable the segmented pads 712', 712" and 712'" to vary the positions at which they contact the blanket 108 to rehydrate, absorb, and remove the surface preparatory material from the blanket 108.

Figure 8:
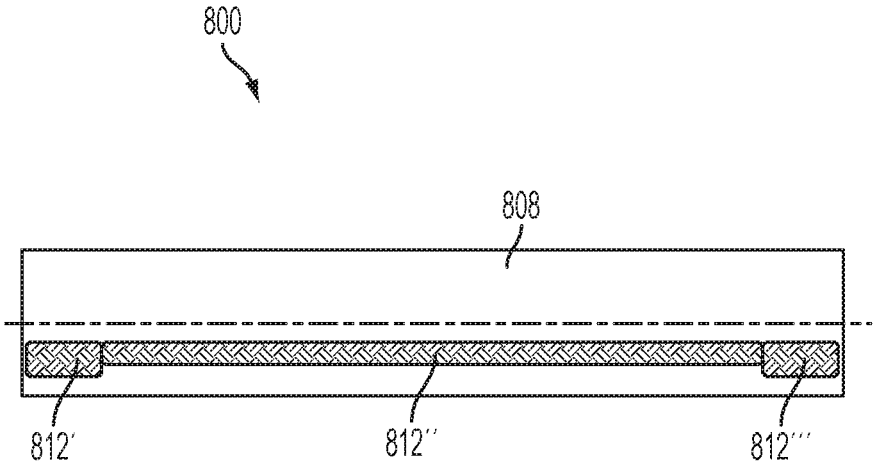
FIG. 8 illustrates an exemplary pad support roller and stepped pads that can be used in a material removal apparatus in accordance with the disclosed subject matter.

FIG. 8 illustrates an exemplary pad support roller 808 and stepped pads 812', 812", and 812'" that can be used in the material removal apparatus 132. The pad support roller 808 can be a stepped pad support roller 808 or a stepped arm. The pad is comprised of a plurality of stepped pads 812', 812", and 812'" mounted on the pad support roller 808. As illustrated herein, the pads 812' and 812' are configured to be longer in the direction of blanket movement than the pad 812". This configuration enables the pads 812' and 812'" to contact the surface of the blanket 108 on the edge margins at positions that are closer to the ink image area than the positions contacted by the pad 812".

Figure 9:
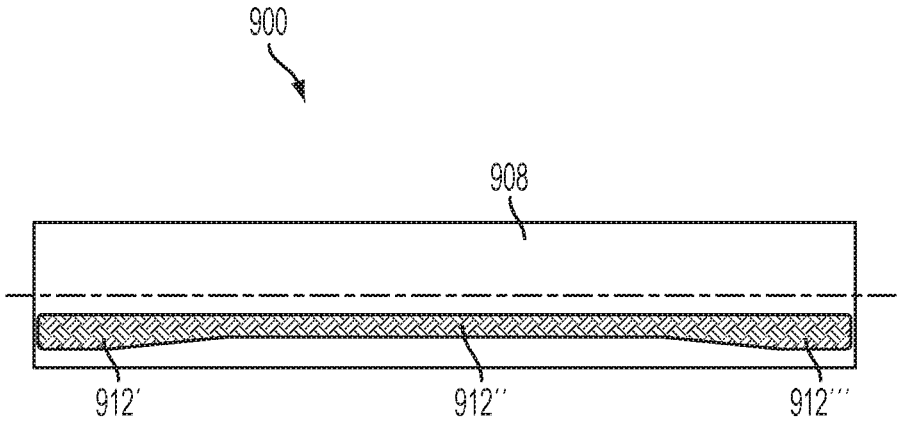
FIG. 9 illustrates another exemplary pad support roller and tapered pads that can be used in a material removal apparatus in accordance with the disclosed subject matter.

FIG. 9 illustrates another exemplary pad support roller 908 and tapered pads 912', 912", and 912'" that can be used in the material removal apparatus 132. The pad support roller 908 can be a tapered pad support roller 908 or a tapered arm. The pad is comprised of a plurality of tapered pads 912', 912", and 912' mounted on the pad support roller 908. As illustrated herein, the pads 912' and 912' are configured to be longer in the direction of the blanket movement than the pad 912". This configuration enables the pads 912' and 912'" to contact the surface of the blanket 108 on the edge margins at positions that are closer to the ink image area than the positions contacted by the pad 912". This configuration also enables the pads 912' and 912'" to contact the surface of the blanket 108 from the outboard edges of the blanket 108 without contacting a center portion of the blanket 108.

Figure 10:
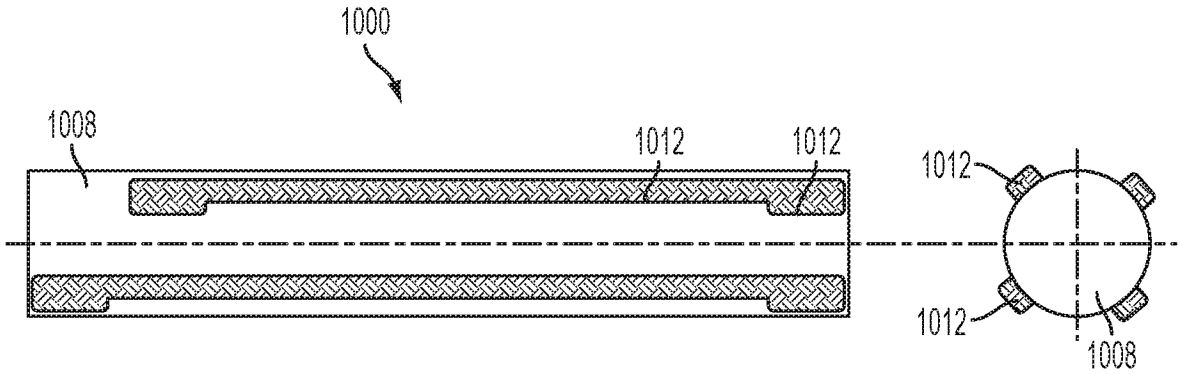
FIG. 10 illustrates another exemplary pad support roller and multiple pads that can be used in a material removal apparatus in accordance with the disclosed subject matter.

FIG. 10 illustrates another exemplary pad support roller 1008 and multiple pads 1012 that can be used in the material removal apparatus 132. The pad support roller 1008 can be a pad support roller 1008 or an arm. Multiple pads 1012 of different configurations are mounted on the pad support roller 1008. The pads 1012 can be tapered pads 1012. In one example, the configurations of the multiple pads 1012 enable the pads 1012 to have a wider contact at the edge margins of the blanket 108. The configurations of the pads 1012 also enable the contact with the blanket 108 to taper from a wider contact at the edge margin of the blanket 108 to a narrower contact at the middle section of the blanket 108.

Figure 11:
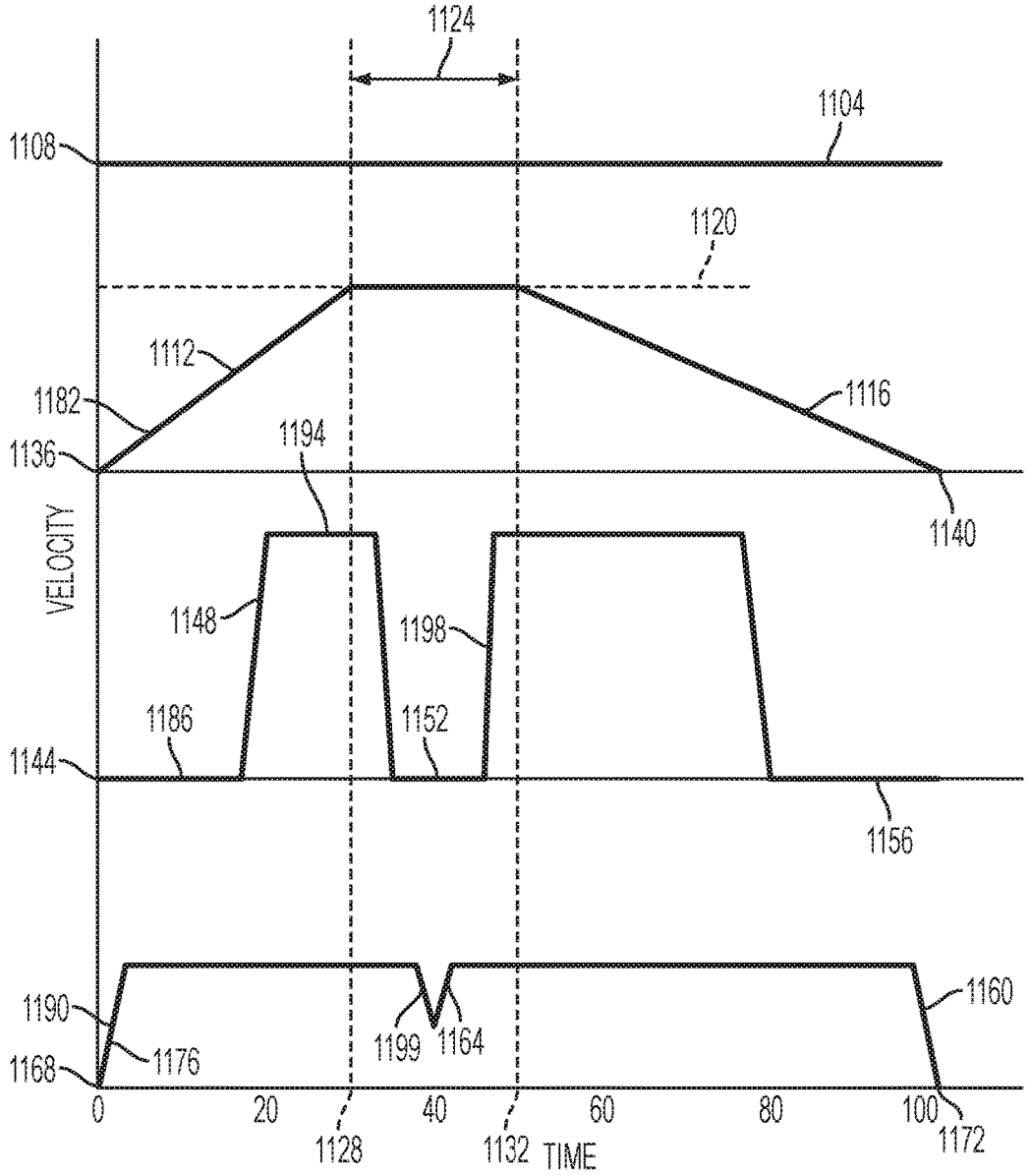
FIG. 11 illustrates an exemplary timing graph for a material removal apparatus having a pad support roller as depicted in FIG. 3 in accordance with the disclosed subject matter.

FIG. 11 illustrates an exemplary timing graph for the material removal apparatus 132' having a pad support roller 308 as depicted in FIG. 3. In the graph, the horizontal axis is time and the vertical axis is velocity. Line $V_{blanket}$ 1104 refers to the constant velocity of the blanket 108. Line 1182 is a line depicting the velocity of the pad support roller 308 in an embodiment in which the roller 308 is rotated with a variable velocity. Line 1186 represents the pad support roller 308 being operated either at a high speed or stopped and line 1190 represents the pad support roller 308 being operated at a constant low speed. The interval $W_{strip}$ 1124 represents the time in which the pad 312 engages the blanket 108 for removal of the surface preparatory material. As such, $W_{strip}$ 1124 indicates the width of the media stripping zone on the blanket 108 or the distance the pad 312 travels on the blanket 108 between the initial contact at time $t_{LE}$ 1128 and contact at time $t_{TE}$ 1132. The media stripping zone can be understood to be an area where the media is stripped from the blanket 108. The $t_{TE}$ 1132 can be determined by equation:

$$t_{TE}=t_{LE}+W_{strip}/V_{blanket} \quad (1)$$

In FIG. 11, line 1182 depicts the operation of the pad support roller 308 at variable speeds between the beginning home position 1136 and the ending position 1140. In the graph, the pad support roller 308 velocity ramps up along slope 1112 and then down along slope 1116. Between the two slopes, the pad 312 contacts the surface of the blanket 108 in the media stripping zone. The velocity $V_{pad}$ 1120 of the pad support roller 308 can be determined using equation:

$$V_{pad}=w_{pad}/(t_{TE}-t_{LE})=2\pi R_{pad}N_{pad} \quad (2)$$

Where, $w_{pad}$ is the width of the pad 312, $R_{pad}$ is the radius of the pad 312, $N_{pad}$ is the number of turns of the pad 312 per unit time, e.g., revolutions per second.

FIG. 11 also illustrates the operation of the pad support roller 308 that includes a stopped position and a constant high speed in line 1186. The pad support roller 308 starts at home position 1144 and the velocity is zero before the velocity rises quickly along slope 1148. The velocity of the pad support roller 308 increases to a constant speed 1194 to position the pad for engaging the blanket 108. The velocity of the pad support roller 308 then stops along 1152 while the pad 312 removes the surface preparatory material from the media stripping zone of the blanket 108. The velocity rises quickly again along slope 1198 to another constant high speed to rotate the pad 312 away from the blanket 108 and through the rehydration and cleaning cycle portions. The pad support roller 308 is then stopped along 1156 in anticipation of the next ink image area needing stripping.

Finally, FIG. 11 illustrates the operation of the pad support roller 308 with a slow constant velocity in line 1190. The velocity rises to this slow velocity along slope 1176 while the pad 312 moves to a position for engaging the blanket 108. The velocity of the pad support roller 308 then slows along slope 1199 while the pad 312 removes the surface preparatory material from the media stripping zone of the blanket 108 before returning along slope 1164 to the slow velocity for rotation away from the blanket 108 and through the rehydration and cleaning cycle portions before being slowed along slope 1160 to a stopped position 1172 in anticipation of the next ink image area needing stripping.

Figure 12:
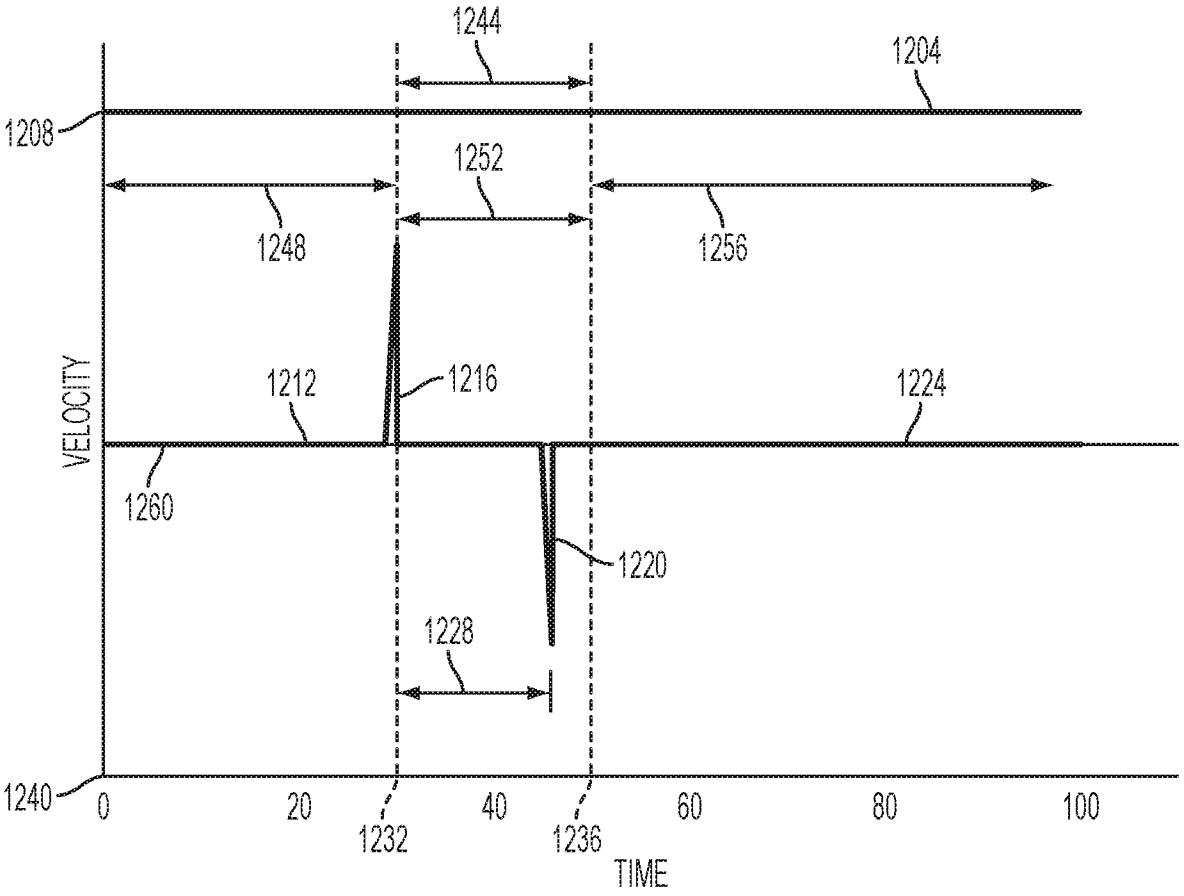
FIG. 12 illustrates another exemplary timing graph for a material removal apparatus having a pad support arm as depicted in FIG. 5 in accordance with the disclosed subject matter.

FIG. 12 illustrates another exemplary timing graph for a material removal apparatus 132" having a pad support arm 508 as depicted in FIG. 5. In the graph, the horizontal axis is time and the vertical axis is velocity. Line $V_{blanket}$ 1204 refers to the constant velocity of the blanket 108. Line 1260 represents the varying velocities of the pad support arm 508 as the pad 512 disengages from the cleaner roller 516 and engages the blanket 108.

FIG. 12 depicts the operation of the pad support arm 508 at variable velocities in line 1260. In the graph, the pad support arm 508 is stopped along slope 1212 for the duration of time interval 1248 when the pad 512 engages with the cleaner roller 516. The velocity of the pad support arm 508 rises suddenly at time $t_{LE}$ 1232 while the pad support arm 508 moves to a position for engaging the blanket 108. The pad 512 moves in the opposite direction of the rotating member 104 when approaching the initial contact with the blanket 108 at time $t_{LE}$ 1232. In this example, a solenoid is used as a controller to disengage the pad 512 from the cleaner roller 516 and bring the pad 512 in contact with the blanket 108 at time $t_{LE}$ 1232. A synchronization signal from the rotating member 104 is configured to determine the timing $t_{LE}$ 1232 of the solenoid actuation to bring the pad 512 into contact at the desired lead edge location of the blanket 108. The position of the pad 512 can be controlled so that when the pad 512 comes in contact with the blanket 108 in the media stripping zone, it does not interfere or remove any ink images. In one example, the trail edge of the media stripping zone can extend into the inter-document gap. The interval $W_{strip}$ 1252 represents the time the pad 512 engages the blanket 108 for removal of the surface preparatory material. As such, $W_{strip}$ 1252 indicates the width of the media stripping zone on the blanket 108 or the distance the pad 312 travels on the blanket 108 between the initial contact at time $t_{LE}$ 1232 and the contact at time $t_{TE}$ 1236. The solenoid can be energized early along the slope 1220 in order to disengage the pad 512 from the blanket 108 due to the width of the pad 512. The interval $t_{dwell}$ 1228 represents a time interval between the time at $t_{LE}$ 1232 where the pad support arm 508 ramps up speed along slope 1216 to engage the pad 512 with the blanket 108 and the time the solenoid is energized along slope 1220 to disengage the pad 512 from the blanket 108. The pad 512 moves away from the blanket 108 and through the rehydration and cleaning cycle portions. The pad support arm 508 is then stopped along 1256 in anticipation of the next ink image area needing stripping. The time $t_{TE}$ 1236 which the pad disengages with the blanket 108 can be determined by equation:

$$t_{TE}=t_{LE}+t_{dwell}+w_{pad}/V_{blanket}=t_{LE}+W_{strip}/V_{blanket} \quad (3)$$

Where, $w_{pad}$ represents the width of the pad 512.

Finally, in the example illustrated in FIG. 12, one or more synchronization signals can occur per revolution cycle of the rotating member 104. Solenoid actuations for additional prints on the blanket 108 can be made between synchronization signals and can be timed from the locations of the image on the blanket 108.

Figure 13:
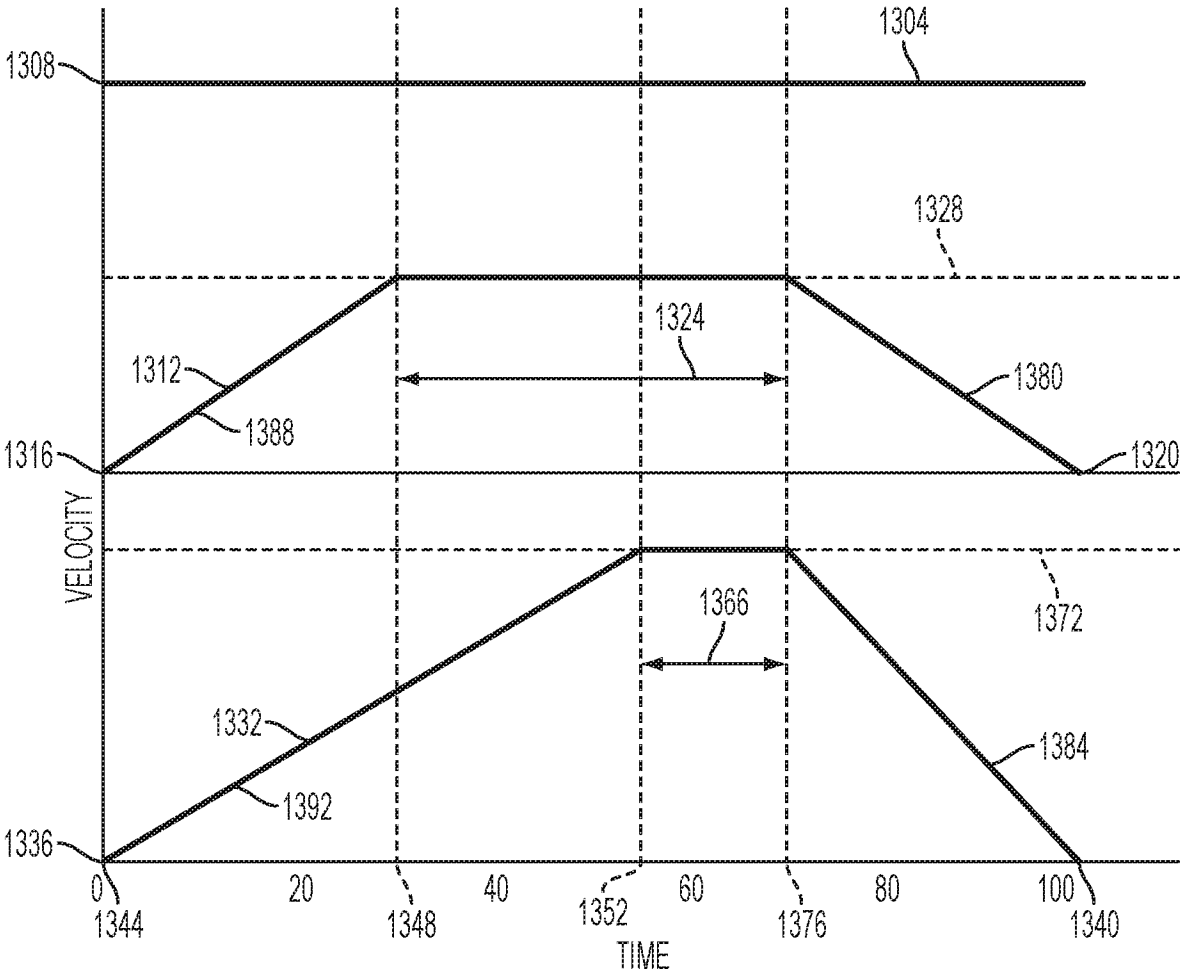
FIG. 13 illustrates another exemplary timing graph for a material removal apparatus having pad support rollers as depicted in FIG. 6A and FIG. 6B in accordance with the disclosed subject matter.

FIG. 13 illustrates another exemplary timing graph for a material removal apparatus 132''' having pad support rollers 608', 608", 608''' as depicted in FIG. 6A and FIG. 6B. In the graph, the horizontal axis is time and the vertical axis is velocity. The segmented pad support rollers 608', 608", and 608''' can rotate at independent variable speeds. Line $V_{blanket}$ 1304 refers to the constant velocity of the blanket 108. Lines 1388 and 1392 illustrate varied velocities of the pad support rollers 608', 608", 608'. Varying the velocities of the pad support rollers 608', 608", 608' as illustrated in lines 1388 and 1392 result in different distances traveled by the pads 612', 612", 612''' on the blanket 108. The different distances the pads 612', 612", 612''' travel on the blanket 108 result in different sizes of the media stripping zone on the blanket 108.

In FIG. 13, line 1388 depicts the operation of the segmented pad support rollers 608', 608", 608', where the margin zone pads 612', 612''' rotate at a slower speed $V_{pad\text{-}margin}$ 1328 than the center zone pad 612", which results in a wider, margin media stripping zone 1324. The margin media stripping zone can be understood to be the margins of the media stripping zone of the blanket 108. In the graph, the margin zone start at home position 1316 where the pads 612', 612", 612' engage with the cleaner roller 616 to hydrate and clean the pads 612', 612", 612'''. The velocity of the pad support rollers 608' and 608''' ramps up along slope 1312 to disengage the pads 612', 612", 612''' from the cleaner roller 616 and engage the blanket 108. The velocity of the pad support rollers 608' and 608''' ramps down along slope 1380 to engage the cleaner roller 616 through the rehydration and cleaning cycle portions before returning to home position 1320 in anticipation of the next ink image area needing stripping.

As further illustrated in FIG. 13, between the two slopes, the margin zone pads 612', 612''' contact the surface of the blanket 108 in the margin stripping zone at a constant velocity $V_{pad\text{-}margin}$ 1328. The velocity of the margin zone pad support rollers 608' and 608''' stays constant along interval 1324. The interval $W_{strip\text{-}margin}$ 1324 represents the time the pads 612', 612''' engage with the blanket 108 for removal of the surface preparatory material. As such, $W_{strip\text{-}margin}$ 1324 indicates the width of the margin media stripping zone on the blanket 108 or the distance the pads 612', 612''' travel on the blanket 108 between the initial contact at time $t_{LE\text{-}margin}$ 1348 and the contact at time $t_{TE\text{-}margin}$ 1376. The width of the margin media stripping zone $W_{strip\text{-}margin}$ 1324 on the blanket 108 can be determined by the rotational speed of the pad support rollers 608', 608''' and the width of the pads 612' and 612'''. In this example, the same width is used for all the pads 612', 612", and 612'''. The outer pads 612' and 612''' of the segmented pad support rollers 608' and 608''' are rotated together to provide a wider media stripping zone on the blanket 108. The velocity $V_{pad\text{-}margin}$ 1328 of the pad support rollers 608', 608''' can be determined using equation:

$$V_{pad\text{-}margin}=w_{pad\text{-}margin}/(t_{TE\text{-}margin}-t_{LE\text{-}margin})=2\pi R_{pad}N_{pad} \quad (4)$$

Where, $w_{pad\text{-}margin}$ is the width of the margin zone pads 612', 612''', $R_{pad}$ is the radius of the pads 612', 612''', $N_{pad}$ is the number of turns of the pads 612', 612''' per unit time, e.g., revolutions per second.

FIG. 13 illustrates in line 1392 the operation of the center zone roller 608", where the center zone pad 612" rotates faster 1372 than the margin zone pads 612', 612" 'resulting in the narrower, center media stripping zone 1366. In the graph, the roller 608" starts at home position 1336, ramps up velocity along slope 1332 to disengage the pad 612' with the cleaner roller 616 and engage the blanket 108. The roller 608" ramps down velocity along slope 1384 to disengage the pad 612' with the blanket 108 and engage the cleaner roller 616 before returning to home position at 1340 in anticipation of the next ink image area needing stripping. Between slopes 1332 and 1384, the pad 612" comes in contact with the surface of the blanket 108 in the center media stripping zone at a constant velocity $V_{pad\text{-}center}$ 1372. The center media stripping zone can be understood to be the center of the media stripping zone on the blanket 108. The interval $W_{strip\text{-}center}$ 1366 represents the time the pad 612" engages with the blanket 108 for removal of the surface preparatory material. As such, $W_{strip\text{-}center}$ 1366 indicates the width of the center media stripping zone on the blanket 108 or and thus indicates the distance the pad 612" travels on the blanket 108 between the initial contact at time $t_{LE\text{-}center}$ 1352 and contact at time $t_{TE\text{-}margin}$ 1376. The velocity $V_{pad\text{-}center}$ 1372 of the roller 608" can be determined using equation:

$$V_{pad\text{-}center}=w_{pad\text{-}center}/(t_{TE\text{-}center}-t_{LE\text{-}center})=2\pi R_{pad}N_{pad} \quad (5)$$

Where, $w_{pad\text{-}center}$ is the width of the center pad 612", $R_{pad}$ is the radius of the pad 612", $N_{pad}$ is the number of turns of the pad 612" per unit time, e.g., revolutions per second. $t_{LE\text{-}center}$ 1352, $t_{TE\text{-}center}$ 1376, and $t_{LE\text{-}margin}$ 1348 can be determined by equations:

$$t_{LE\text{-}center}=t_{LE\text{-}margin}+w_{strip\text{-}margin}/V_{blanket} \quad (6)$$

$$t_{TE\text{-}center}=t_{LE\text{-}center}+w_{strip\text{-}center}/V_{blanket} \quad (7)$$

$$t_{TE\text{-}margin=tTE\text{-}center} \quad (8)$$

A controller can control actuators, such servos or stepper motors, to rotate the pad support rollers 608', 608", and 608". The motors can be operated at variable speeds as illustrated in FIG. 13. In another example, the controller can be configured to operate the actuators at fixed speeds and include stops and delays that are built into the timing of the operation of the pad support rollers 608', 608", and 608" to provide the desired length of contact of the pads 612', 612", and 612'" with the blanket 108. In another example, a single motor instead of multiple motors can be used. The single motor with a constant speed can drive a common shaft through the segmented pad support rollers 608', 608", and 608'". With the single motor, the controller can regulate the rotation of the pad support rollers 608', 608", 608'" using a device, such as a clutch or brakes, to either rotate the pads 612', 612", 612'" at the shaft speed or stop the pads 612', 612", 612'".

Figure 14:
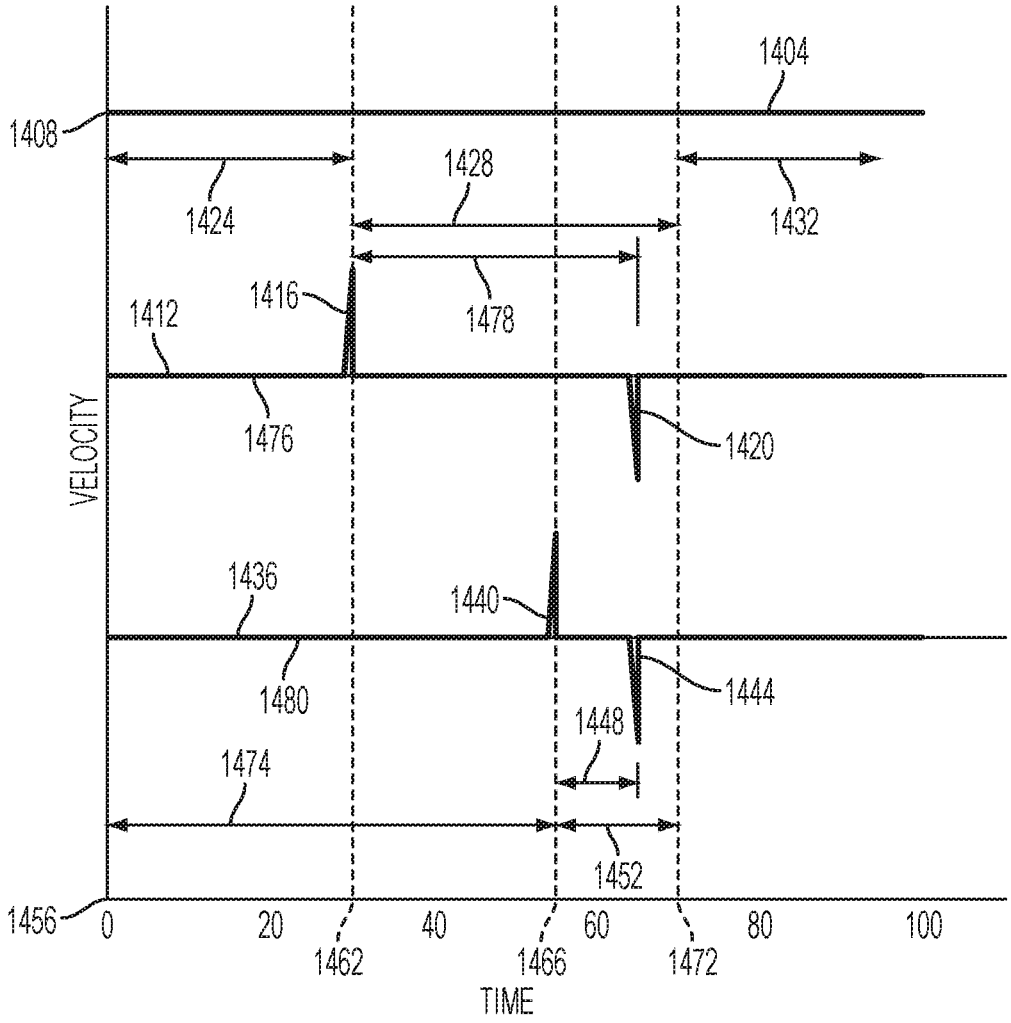
FIG. 14 illustrates another exemplary timing graph for a material removal apparatus having pad support arms as depicted in FIG. 7A and FIG. 7B in accordance with the disclosed subject matter.

FIG. 14 illustrates another exemplary timing graph for the material removal apparatus 132" having pad support arms 708', 708", 708'" as depicted in FIG. 7A and FIG. 7B. In the graph, the horizontal axis is time and the vertical axis is velocity. Line $V_{blanket}$ 1404 refers to the constant velocity of the blanket 108. Line 1476 represents the varying velocities of the margin zone pad support arms 708', 708'" as the pads 712', 712'" disengage from the cleaner roller 716 and engage the blanket 108. Line 1480 represents the varying velocities of the center zone arm 708" as the pad 712" disengages from the cleaner roller 716 and engages the blanket 108.

FIG. 14 depicts the operation of the margin zone pad support arms 708', 708'" in line 1476. In the graph, the pad support arms 708', 708'" are stopped along slope 1412 for the duration of the time 1424 the pads 712', 712'" engage the cleaner roller 716. A solenoid is used as a controller to disengage the pads 712', 712'" from the cleaner roller 516 and bring the pads 712', 712'" in contact with the blanket 108 at time $t_{LE\text{-}margin}$ 1462. The pads 712', 712'" move in the opposite direction of the rotating member 104 when approaching the initial contact with the blanket 108 at time $t_{LE\text{-}margin}$ 1462. A synchronization signal from the rotating member 104 is configured to determine the timing of the solenoid actuation to bring the pads 712', 712'" into contact 1462 at the desired lead edge location of the blanket 108. The position of the pads 712', 712'" can be controlled so that when the pads 712', 712'" come in contact with the blanket 108 in the media stripping zone, it does not interfere or remove any ink images. The interval $W_{strip\text{-}margin}$ 1428 represents the time the pads 712', 712'" engage with the blanket 108 for removal of the surface preparatory material and thus indicates the distance the pads 712', 712'" travel on the blanket 108 between the initial contact at time $t_{LE\text{-}margin}$ 1462 and contact at time $t_{TE\text{-}margin}$ 1472. The solenoid can be energized early along the slope 1420 in order to disengage the pads 712', 712'" from the blanket 108 due to the width of the pads 712', 712'". The interval $t_{dwell\text{-}margin}$ 1478 represents a time interval between the time at $t_{LE\text{-}margin}$ 1462 where the solenoid ramps up speed along slope 1416 to engage the pads 712', 712'" with the blanket 108 and the time the solenoid is energized along slope 1420 to disengage the pads 712', 712'" from the blanket 108. During the interval 1432, the margin zone pads 712', 712'" engage with the cleaner roller 716 through the rehydration and cleaning cycle portions before returning to home position in anticipation of the next ink image area needing stripping.

FIG. 14 also depicts the operation of the center zone arm 708" in line 1480. The intervals 1474 and 1432 represent the time the center zone pad 712" engages with the cleaner roller 716. In the graph, the pad support arms 708" stop along slope 1436 for the duration of the time the pad 712" engages with the cleaner roller 716. The interval $W_{strip\text{-}center}$ 1452 represents the time the pad 712" engages with the blanket 108 for removal of the surface preparatory material and thus indicates the distance the pad 712" travels on the blanket 108 between the initial contact at time $t_{LE\text{-}center}$ 1466 and contact at time $t_{TE\text{-}center}$ 1472. The solenoid can be energized early along the slope 1444 in order to disengage the pad 712" from the blanket 108 due to the width of the pad 712". The interval $t_{dwell\text{-}center}$ 1448 represents a time interval between the time at $t_{LE\text{-}center}$ 1466 where the solenoid ramps up speed along slope 1440 to engage the pad 712" with the blanket 108 and the time the solenoid is energized along slope 1420 to disengage the pad 712" from the blanket 108. $t_{LE\text{-}center}$ 1466, $t_{TE\text{-}center}$1472, and $t_{LE\text{-}margin}$1462 can be determined by equations:

$$t_{LE\text{-}center}=t_{LE\text{-}margin}+w_{strip\text{-}margin}/V_{blanket} \tag{9}$$

$$t_{TE\text{-}center}=t_{LE\text{-}center}+w_{strip\text{-}center}/V_{blanket} \tag{10}$$

$$t_{TE\text{-}margin=tTE\text{-}center} \tag{11}$$

Figure 15:
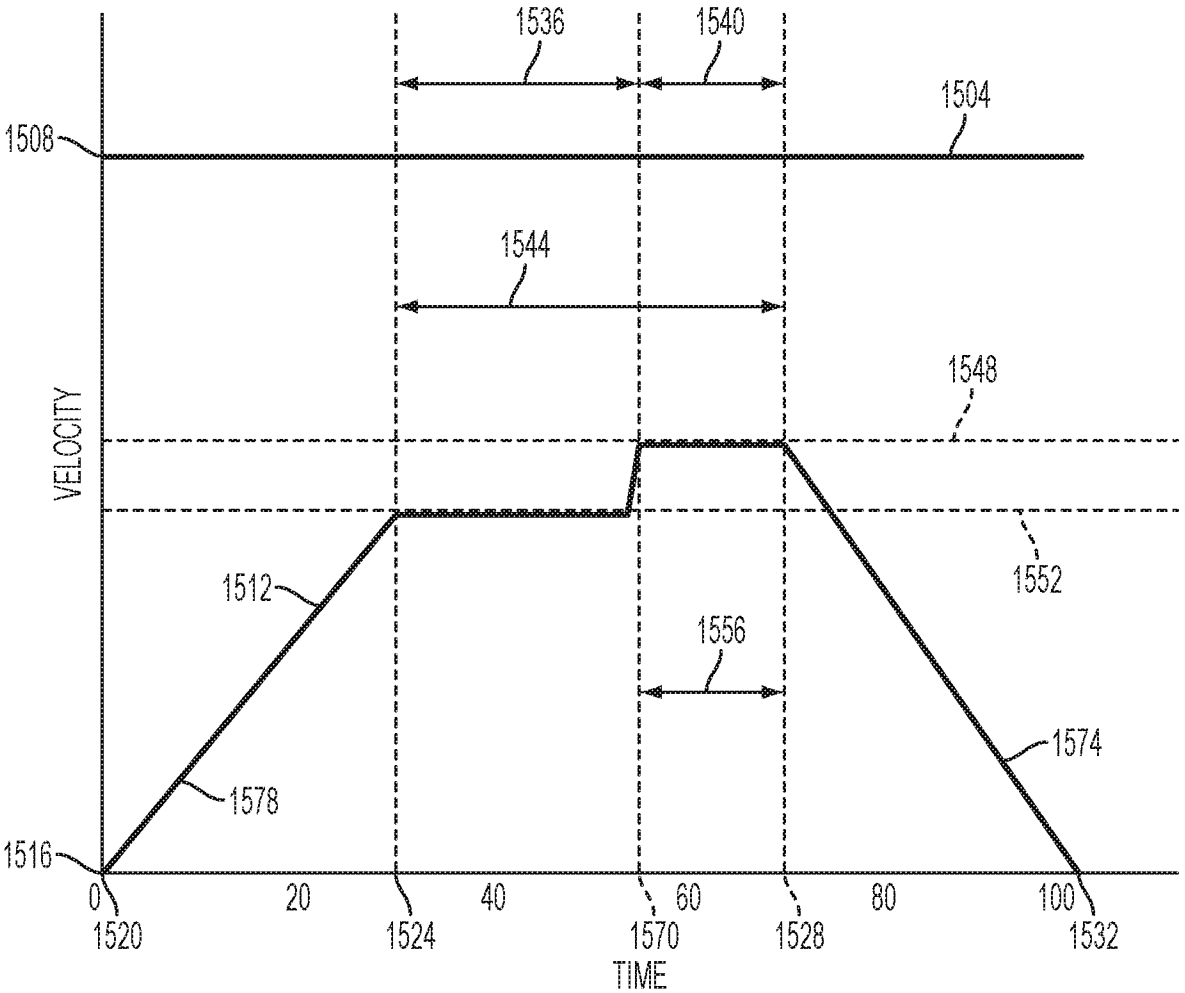
FIG. 15 illustrates another exemplary timing graph for a material removal apparatus having a pad support roller as depicted in FIG. 8 in accordance with the disclosed subject matter.

FIG. 15 illustrates another exemplary timing graph for the material removal apparatus 132 having a pad support roller 808 as depicted in FIG. 8. The pad 812', 812", 812'" has stepped width zones. The ends of the pad 812', 812'" are wider in the print margin zone and the center of the pad 812" is narrower in the center of the print. In the graph, the horizontal axis is time and the vertical axis is velocity. Line $V_{blanket}$ 1504 refers to the constant velocity of the blanket 108. Line 1578 represents the varying velocities of the pad support roller 808 as the pad 812', 812", 812'" disengages from the cleaner roller 316 and engages with the blanket 108.

In FIG. 15, line 1578 depicts the operation of the pad support roller 808. In the graph, the pad support roller 808 starts at home position 1516, the velocity ramps up along slope 1512. As the pad support roller 808 rotates towards the blanket 108, the wider, margin zone of the pad 812', 812'" contacts with the blanket 108 first. The speed of the pad support roller 808 is adjusted to allow the margin zone of the pad 812', 812'" to contact with the blanket 108 for the desired length 1544 of the lead-edge margin media stripping zone. $W_{strip\text{-}margin}$ 1544 represents the time in which the pad 812', 812'" engages the blanket 108 for removal of the surface preparatory material and thus indicates the distance the pad 812', 812'" travels on the blanket 108 between the initial contact at time $t_{LE\text{-}margin}$ 1524 and contact at time $t_{TE\text{-}margin}$ 1528. After the initial contact with the blanket 108 at time $t_{LE\text{-}margin}$ 1524, the velocity of the pad support roller 808 stays constant at $V_{pad\text{-}margin}$ 1552. The velocity $V_{pad\text{-}margin}$ 1552 of the pad support roller 808 can be determined by equation:

$$V_{pad\text{-}margin}=w_{pad\text{-}margin}/(t_{TE\text{-}margin}-t_{LE\text{-}margin})=2\pi R_{pad}N_{pad} \tag{12}$$

Where, $w_{pad\text{-}margin}$ is the width of the margin sections of the pads 812', 812'", $R_{pad}$ is the radius of the pads 812', 812'", $N_{pad}$ is the number of turns of the pads 812', 812'" per unit time, e.g., revolutions per second.

FIG. 15 further illustrates that the speed of the pad support roller 808 ramps up after time $t_{LE\text{-}center}$ 1570 to allow contact across the full width of the print. The full width contact of pad support roller 808 with the blanket 108 occurs for the desired length $W_{strip\text{-}margin}$ 1556 of the center lead-edge margin stripping zone. The velocity $V_{pad\text{-}center}$ 1548 of the roller stays constant for the interval 1556 of time. The velocity of the pad support roller 808 then ramps down along slope 1574 and returns to the home position at 1532 so that the pads 812', 812", 812'" engage the cleaner roller 316 through the rehydration and cleaning cycle portions before returning to the home position 1532 in anticipation of the next ink image area needing stripping. In one example, a controller can operate a servo or stepper motor to control rotation and movement of the pad support roller 808 at variable speeds. In another example, the controller can be configured to rotate the pads 812', 812", 812'" at desired locations and then stop or delay the rotation to provide the desired length of contact with the blanket. The velocity Vpad-center 1548 of the pad support roller 808 can be determined by equation:

$$V_{pad\text{-}center}=w_{pad\text{-}center}/(t_{TE\text{-}center}-t_{LE\text{-}center})=2\pi R_{pad}N_{pad} \quad (13)$$

Where, $w_{pad\text{-}center}$ is the width of the center section of the pad 812", $R_{pad}$ is the radius of the pad 812", $N_{pad}$ is the number of turns of the pad 812" per unit time, e.g., revolutions per second.

$t_{LE\text{-}margin}$ 1524, $t_{TE\text{-}center}$ 1528, and $t_{LE\text{-}center}$ 1570 can be determined by the following equations:

$$t_{LE\text{-}center}=t_{LE\text{-}margin}+w_{strip\text{-}margin}/V_{blanket} \quad (14)$$

$$t_{TE\text{-}center}=t_{LE\text{-}center}+w_{strip\text{-}center}/V_{blanket} \quad (15)$$

$$t_{TE\text{-}margin=tTE\text{-}center} \quad (16)$$

Figure 16:
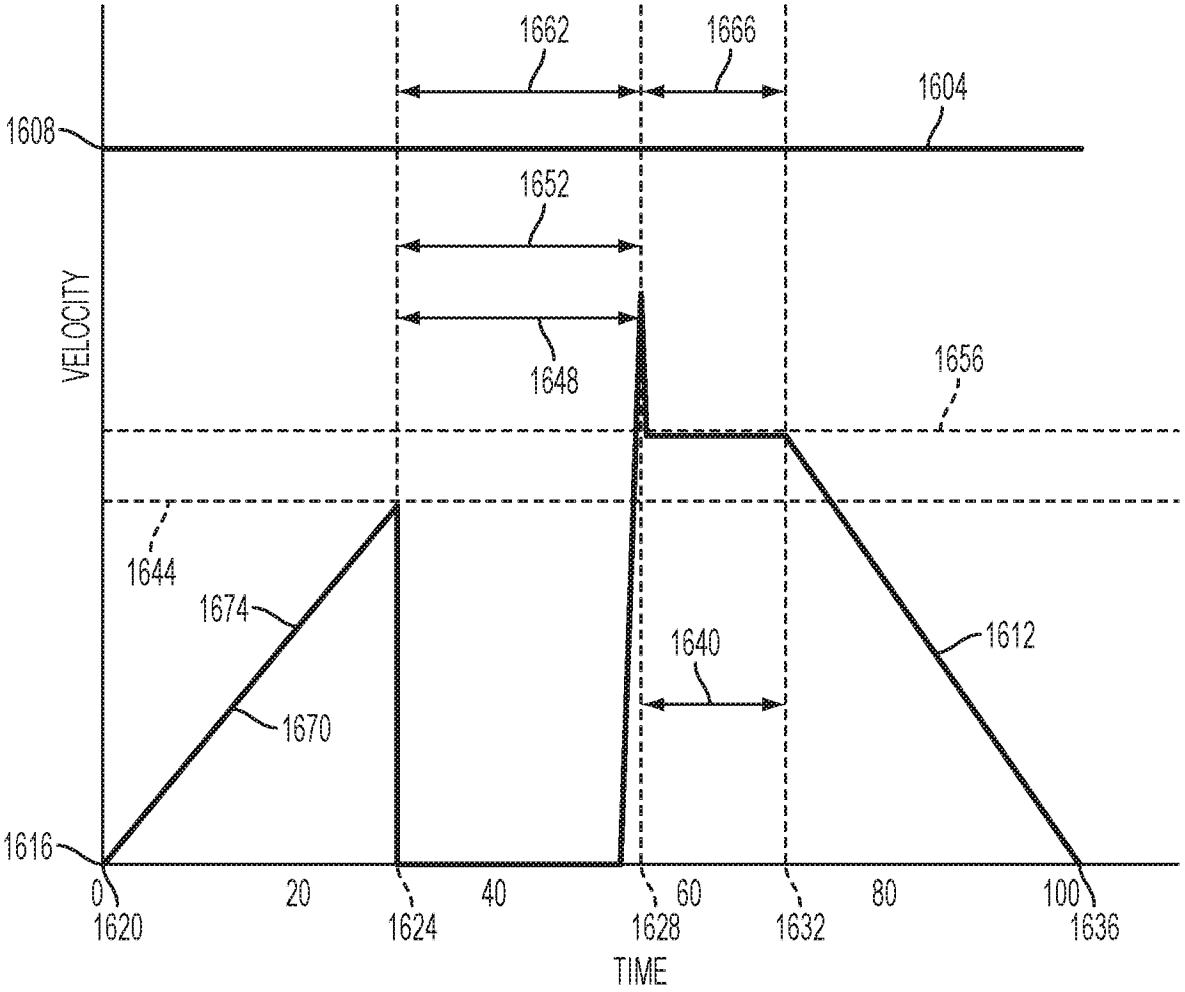
FIG. 16 illustrates another exemplary timing graph for a material removal apparatus having a pad support roller as depicted in FIG. 9 in accordance with the disclosed subject matter.

FIG. 16 illustrates another exemplary timing graph for the material removal apparatus 132 having a pad support roller 908 as depicted in FIG. 9. The tapered pad 912', 912", 912'" has wider margin sections 912', 912'" and tapered regions join a narrower center section 912" of the pad. In the graph, the horizontal axis is time and the vertical axis is velocity. Line $V_{blanket}$ 1604 refers to the constant velocity of the blanket 108. Line 1670 represents the varying velocities of the pad support roller 908 as the pad 912', 912", 912'" disengages from the cleaner roller 316 and engages with the blanket 108.

In FIG. 16, line 1670 depicts the operation of the pad support roller 908. In the graph, the pad support roller 908 starts at home position 1616, the velocity ramps up along slope 1674 to engage the pad 912', 912", 912'" with the blanket 108 until it reaches velocity $V_{pad\text{-}taper}$ 1644. As the tapered portion of the pad 912', 912'" rotates towards the blanket 108 and comes in contact with the blanket 108 at time $t_{LE\text{-}taper}$ 1624, the pad support roller 908 stops at a section of the tapered pad 912', 912'" for interval 1662. As such, the tapered portion of the pad 912', 912'" is in contact with the tapered media stripping zone of the blanket 108 for the desired print margin. $W_{strip\text{-}taper}$ 1652 represents the time in which the pad 912', 912'" engages the blanket 108 for removal of the surface preparatory material and thus indicates the distance the pad 912', 912'" travels on the blanket 108 between the initial contact at time $t_{LE\text{-}taper}$ 1624 and contact at time $t_{LE\text{-}center}$ 1628. The dwell time $t_{dwell}$ 1648 represents the total time the pad 912', 912", 912'" contacts at the tapered portion of the pad 912', 912'" with the blanket 108 and determines the length of the lead-edge margin media stripping zone of the blanket 108. The pad support roller 908 then quickly accelerates at time $t_{LE\text{-}center}$ 1628 to a full width contact of the pads 912', 912", 912'" with the blanket 108. The velocity is then adjusted to velocity $V_{pad\text{-}center}$ 1656 for a desired length of contact with the center lead-edge media stripping zone of the blanket 108. As such, during the interval 1666, the entire pad 912', 912", and 912'" is in contact with the center stripping zone of the blanket 108. $W_{strip\text{-}center}$ 1640 represents the time in which the entire pad 912', 912", 912'" engages the blanket 108 for removal of the surface preparatory material and thus indicates the distance the pad 912', 912", 912'" travels on the blanket 108 between the contact at time $t_{LE\text{-}center}$ 1628 and the contact at time $t_{TE\text{-}center}$ 1632. The velocity of the pad support roller 908 ramps down along slope 1612 as the pad 912', 912", 912'" moves away from the blanket 108 and through the rehydration and cleaning cycle portions. The pad support roller 908 reaches back to home position 1636 in anticipation of the next ink image area needing stripping. The velocity $V_{pad\text{-}taper}$ 1644 can be determined by equation:

$$V_{pad\text{-}taper}=w_{pad\text{-}taper}/(t_{TE\text{-}taper}-t_{LE\text{-}taper})=2\pi R_{pad}N_{pad} \quad (17)$$

Where, $w_{pad\text{-}taper}$ is the width of the tapered sections of the pads 912', 912'", $R_{pad}$ is the radius of the pads 912', 912'", $N_{pad}$ is the number of turns of the pads 912', 912'" per unit time, e.g., revolutions per second.

The velocity $V_{pad\text{-}center}$ 1656 can be determined by equation:

$$V_{pad\text{-}center}=w_{pad\text{-}center}/(t_{TE\text{-}center}-t_{LE\text{-}center})=2\pi R_{pad}N_{pad} \quad (18)$$

Where, $w_{pad\text{-}center}$ is the width of the center section of the pad 912", $R_{pad}$ is the radius of the pad 912", $N_{pad}$ is the number of turns of the pad 912" per unit time, e.g., revolutions per second.

$t_{LE\ margin}$ 1624, $t_{TE\text{-}center}$ 1632, and $t_{LE\text{-}center}$ 1628 can be determined by the following equations:

$$t_{LE\text{-}center}=t_{LE\text{-}taper}+w_{strip\text{-}taper}/V_{blanket} \quad (19)$$

$$t_{TE\text{-}center}=t_{LE\text{-}center}+w_{strip\text{-}center}/V_{blanket} \quad (20)$$

$$t_{TE\text{-}taper=tTE\text{-}center} \quad (21)$$

In the graph illustrated in FIG. 16, the pad 912', 912", 912'" moves through narrower tapers before stopping at the desired width on the tapered section at interval 1662. As such, the pattern of the surface preparatory material removed from the blanket 108 will not have square corners. If the transitions before and after the stopping location on the tapered section at interval 1662 are fast enough, then the deviation from the square pattern may be small. If the transitions before and after the stopping location on the tapered section at interval 1662 are longer, then the pattern of the surface preparatory material removed from the blanket 108 has rounded corners. In one example, when the pad transitions from the tapered section at interval 1662 to the center section at interval 1666, the rounding of the inside corner should not interfere with the ink images on the blanket 108.

Figure 17:
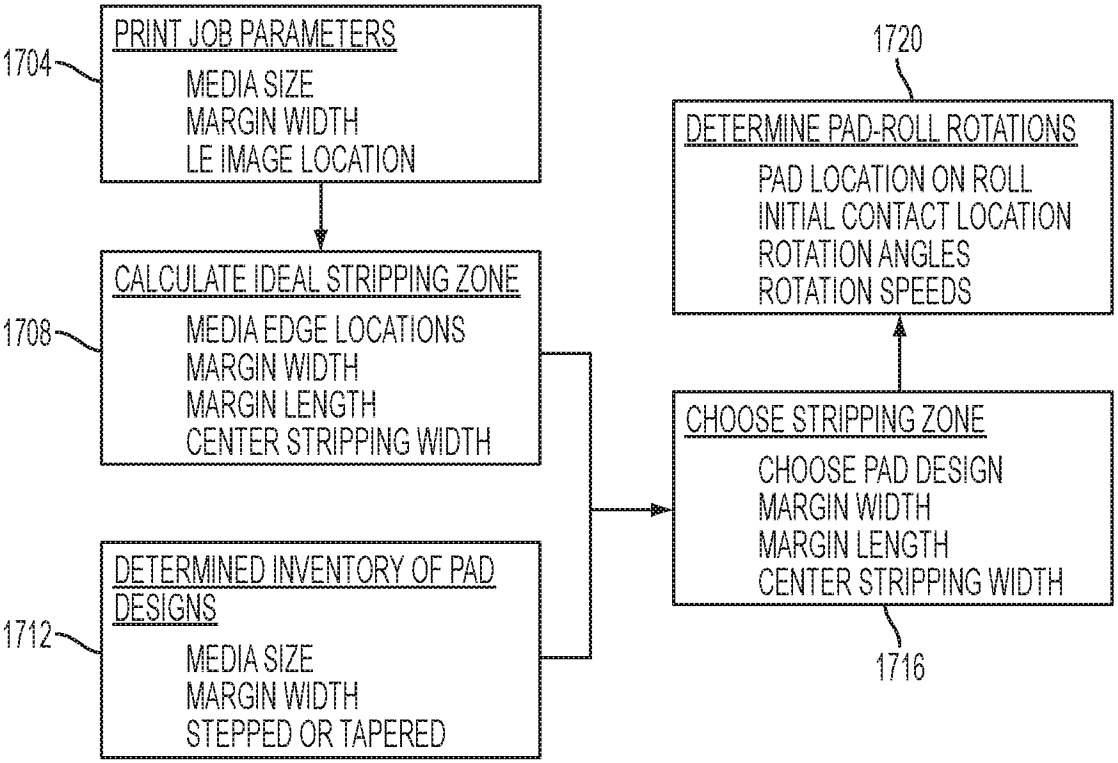
FIG. 17 illustrates an exemplary process chart for a material removal apparatus having a pad support roller as depicted in FIG. 10 in accordance with the disclosed subject matter.

FIG. 17 illustrates an exemplary process flow for the material removal apparatus 132 having a pad support roller 1008 as depicted in FIG. 10. As illustrated in FIG. 10, multiple pads 1012 of different configurations are mounted on the pad support roller 1008. As such, the parameters for printing the image on the blanket 108 are determined (Step 1704). The parameters can include, but is not limited to, determining the size of the media 144, the width of the margin, the location of the leading edge of the image on the blanket 108, or the like.

In FIG. 17, the process then calculates the stripping zone on the blanket 108 (Step 1708). Determining the stripping zone on the blanket 108 can include, but is not limited to, determining the locations of the edge of the media 144, determining the width of the margin of the media stripping zone on the blanket 108, determining the length of the margin of the media stripping zone on the blanket 108, determining the width of the center stripping zone on the blanket 108, or the like. Additionally, the process determines the inventory of the designs on the multiple pads 1012 (Step 1712). This can include, but is not limited to, determining the size of the media 144, determining the width of the margin of the media stripping zone on the blanket 108, determining whether the multiple pads 1012 are stepped or tapered, or the like.

In FIG. 17, the process further chooses a stripping zone on the blanket 108 (Step 1716). This selection can include, but is not limited to, identifying a design of a pad from the multiple pads 1012, determining the width of the margin, determining the length of the margin, determining the width of the center stripping zone, or the like. The process further includes determining the rotations of the pad support roller 1008 (Step 1720). The rotation parameters can include, but are not limited to, determining the location of the multiple pads 1012, determining the location of the initial contact of the multiple pads 1012, determining the rotation angles of the multiple pads 1012, determining the rotation speeds of the multiple pads 1012, or the like.

Figure 18:
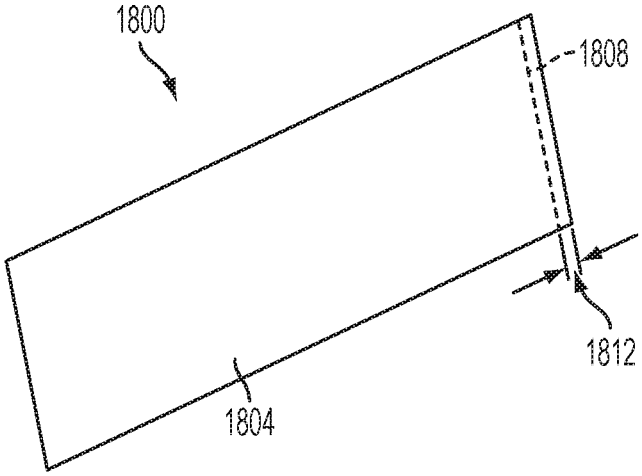
FIG. 18 illustrates an exemplary portion of a blanket surface in which an exemplary lead edge deletion strip is produced with the material removal apparatus before an ink image area in accordance with the disclosed subject matter.

FIG. 18 illustrates an exemplary portion 1800 of a blanket surface in which an exemplary lead edge deletion strip 1808 is produced with the material removal apparatus 132 in advance of an ink image area 1804. An ink image (not depicted) is printed within the area 1804. The pad 312 of the apparatus 132 removes a width 1812 of the surface preparatory material to form the lead edge deletion strip 1800.

Figure 19:
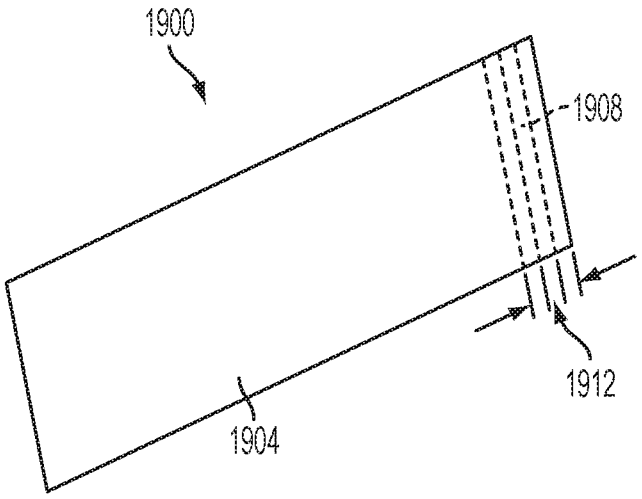
FIG. 19 illustrates another exemplary portion of a blanket surface in which an exemplary lead edge deletion strip is produced with the material removal apparatus before an ink image area in accordance with the disclosed subject matter.

FIG. 19 illustrates another exemplary portion 1900 of a blanket surface in which an exemplary lead edge deletion strip 1908 is produced with the material removal apparatus 132 before an ink image area 1904 on the blanket. An ink image (not depicted) is printed within the area 1904. The pad 312 of the apparatus 132 removes a width 1912 of the surface preparatory material to form the lead edge deletion strip 1908. The width 1912 of the surface preparatory material removed from the blanket 108 can vary depending on the stiffness of the media 144. In one example, for a media 144 with low stiffness can enable the removal of a wider width 1912 of the surface preparatory material from the blanket 108. Examples of media 144 with low stiffness include, but are not limited to a thin paper or the like. In another example, a media 144 with high stiffness can enable the removal of a thinner width 1912 of the surface preparatory material from the blanket 108. Examples of media 144 with high stiffness include, but are not limited to a thick paper or the like. If the media 144 is very stiff, then a method to remove surface preparatory material from the blanket 108 may not be needed. An example of media 144 that is very stiff includes, but is not limited to, a cardstock or the like.

Figure 20:
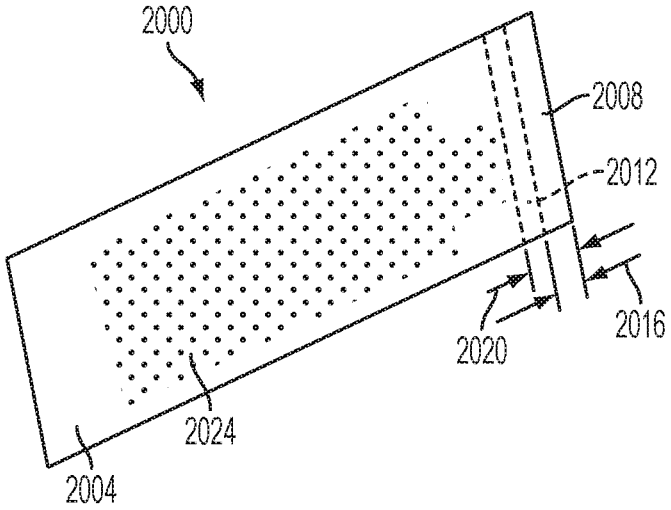
FIG. 20 illustrates another exemplary portion of a blanket surface in which an exemplary lead edge deletion strip is produced with the material removal apparatus before an ink image area in accordance with the disclosed subject matter.

FIG. 20 illustrates another exemplary portion 2000 of a blanket surface in which an exemplary lead edge deletion strip 2008, 2012 is produced with the material removal apparatus 132 in advance of an ink image area 2004. An ink image 2024 is printed within the area 2004. Width 2020 represents the maximum width of the surface preparatory material 2012 removed from the blanket 108. Width 2016 represents the minimum width of the surface preparatory material 2008 removed from the blanket 108. Removing a maximum width 2020 of the surface preparatory material 2012 can provide a higher reliability of stripping the media 144 from the blanket 108. The maximum width 2020 can be determined by the lead edge margin to the start of the ink image 2024. The minimum width 2016 can be determined by the stiffness of the media 144.

Figure 21:
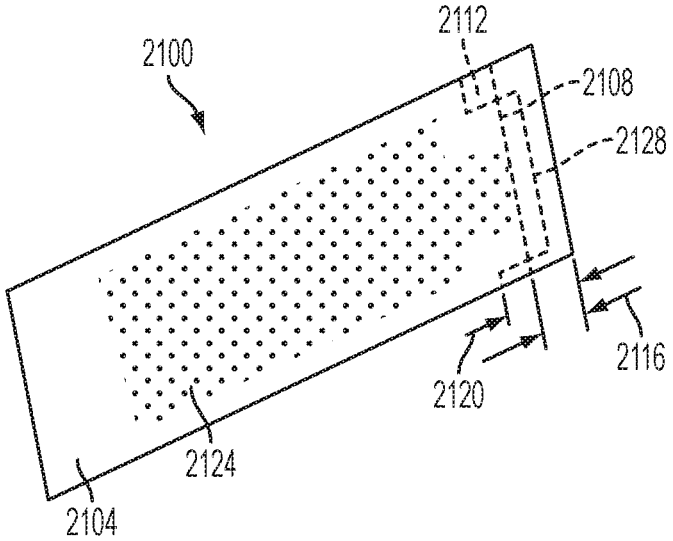
FIG. 21 illustrates another exemplary portion of a blanket surface in which an exemplary lead edge deletion strip is produced with the material removal apparatus before an ink image area in accordance with the disclosed subject matter.

FIG. 21 illustrates another exemplary portion 2100 of a blanket surface in which an exemplary lead edge deletion strip 2108, 2112 is produced with the material removal apparatus 132 in advance of an ink image area 2104. An ink image 2124 is printed within the area 2104. The exemplary lead edge deletion strip 2108, 2112 is configured for the shape of the ink image 2124. Line 2128 represents the minimum width that is required for stripping the surface preparatory material where the minimum width is determined by the media stiffness. Width 2116 represents the maximum width of the surface preparatory material 2108 removed from the center of blanket 108 without removing the ink image 2124. Width 2120 represents the surface preparatory material 2118 removed from the blanket 108 that is configured for the shape of the ink image 2124. Different embodiments of material removal apparatus 132 or the stepped pad support roller 808 described herein can be used to remove a wider width of the surface preparatory material 2118 and further configure the removal pattern to the shape of the ink image 2124. The shape of the surface preparatory material 2118 can be configured to extend beyond the image 2124 on the edges as seen by reference 2112. In this manner, the shape of the surface preparatory material 2112 removed from the blanket 108 avoids deleting the content of the ink image 2124 while providing areas of high reliability media stripping. As such, the lead corners of the media 144 can easily strip and enable the stripping of the media 144 closer to the area of the ink image 2124 as well.

Figure 22:
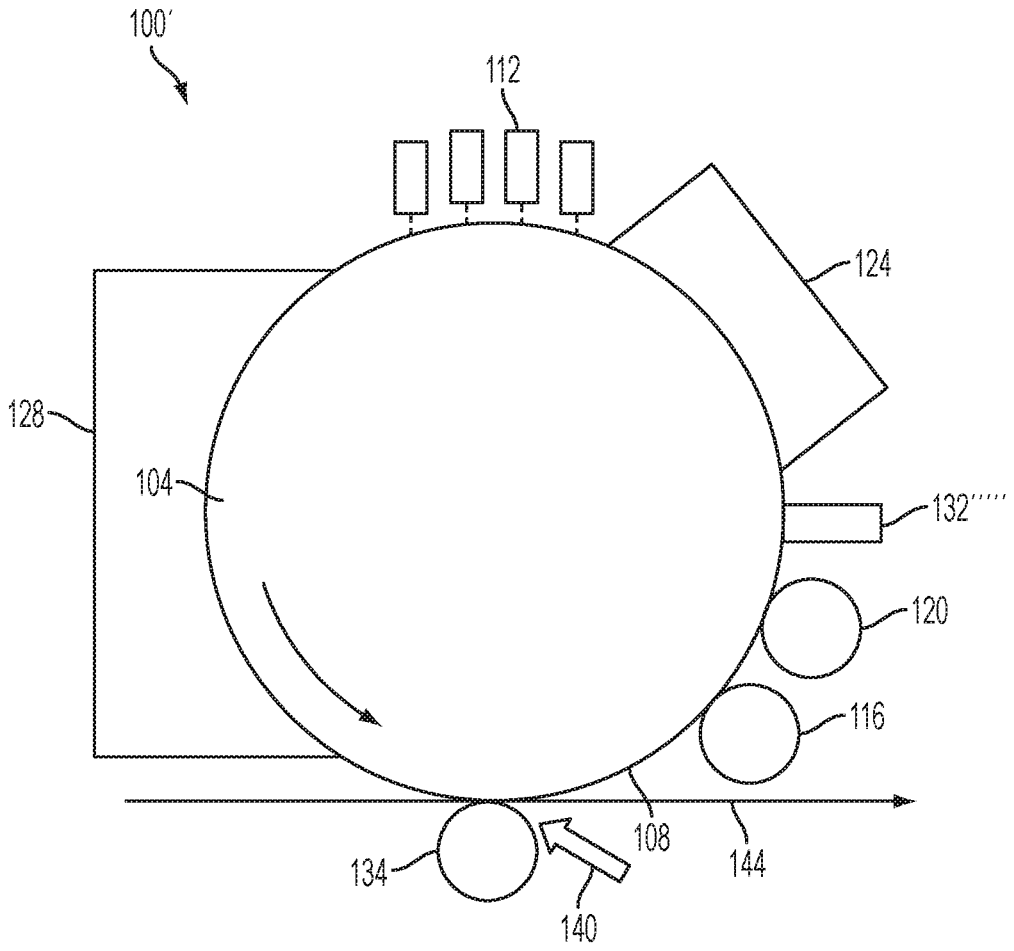
FIG. 22 shows an embodiment of a printer that removes a portion of the surface preparatory material to facilitate leading edge separation from the blanket with the surface preparatory material remover being positioned differently than the printer in FIG. 1.
Figure 23A:
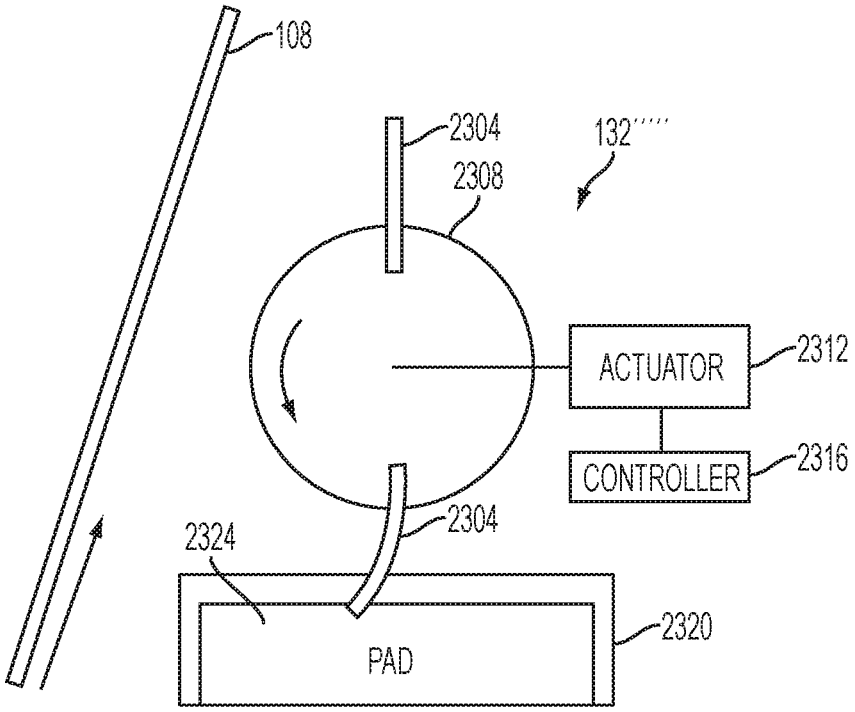
FIG. 23A and FIG. 23B show an alternative embodiment of a surface preparatory material remover depicted in FIG. 22.
Figure 23B:
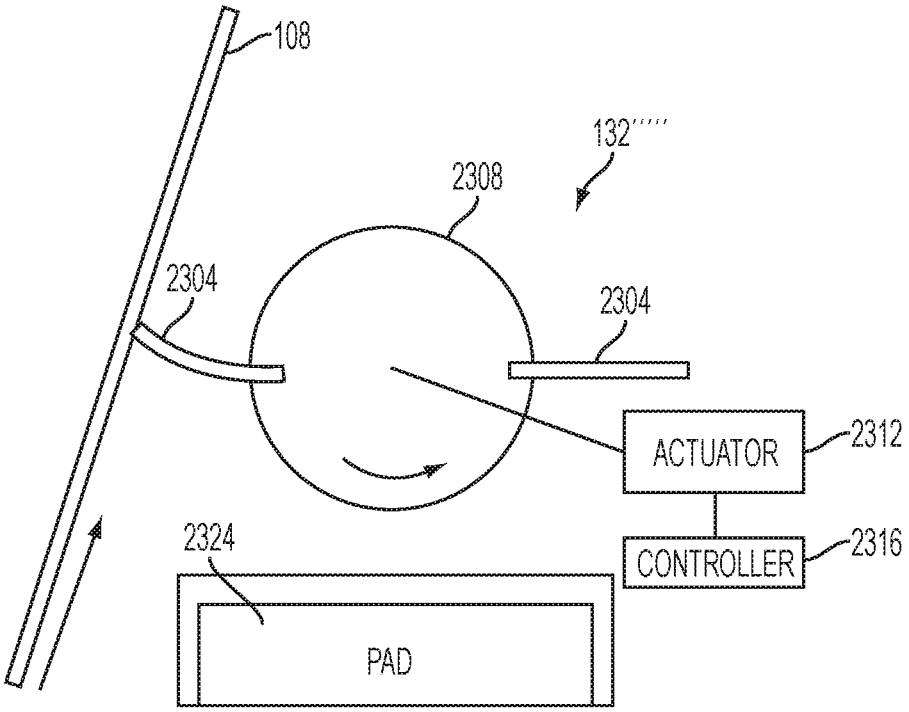

An embodiment of a printer 100' is shown in FIG. 22. This embodiment is similar to the one shown in FIG. 1 except the surface preparatory material remover 132'''' is positioned between applicator 120 and dryer 124. This positioning takes advantage of the dampness of the surface preparatory material prior to it being dried by the dryer 124. One embodiment of the remover 132'''' is shown in FIG. 23A and FIG. 23B. The remover 132'''' includes a plurality of elastomeric cleaning blades 2304, which are mounted radially on a roller 2308. The roller 2308 is driven by an actuator 2312, such as a stepper motor or other suitable drive unit that is capable of rotating the shaft at 90-180 degree intervals. Rotation of the roller 2308 also rotates the blades 2304 in the direction shown by the arrow in the figures. The rotating member 104 (FIG. 22) prevents the blanket 108 from deflecting away from the blades 2304. The actuator 2304 can also be configured to move with reference to the blanket 108 to regulate the gap between the blanket 108 and roller 2308 to ensure consistent blade deflection and wiping pressure. A controller 2316 is operatively connected to the actuator 2312 to drive the roller 2308 in synchronization with the document zone length on the blanket 108 so the blades 2304 contact the blanket 108 and remove surface preparatory material from the blanket within the inter document gap between document zones on the blanket plus some predetermined margin. In one embodiment, the first 2-3 mm of the document zone corresponds to the predetermined margin. The remainder of the surface preparatory material is dried on the blanket 108 by the dryer 124 and the printheads 112 form an ink image on the blanket, which is dried by dryer 128. When the media enters the transfer nip in synchronization with the dried ink image, the absence of the surface preparatory material at the leading edge of the blanket 108 facilitates separation of the leading edge from the blanket as the leading edge exits the nip 140 (FIG. 22). A receptacle 2320 is configured to hold a pad or web 2324 and is positioned to enable tips of the blades 2304 to contact the pad or web 2324 as they pass the receptacle 2320. The pad or web 2324 can be provided with a solvent, such as water or another chemical that helps remove the surface preparatory material from the blanket 108. The engagement of the blade tips across the pad or web after each wiping cycle removes excess skin from the blade tips. The pad or web 2324 is cleaned or replace at designated service intervals to replenish the cleaning capability of the pad or web.

Figure 24A:
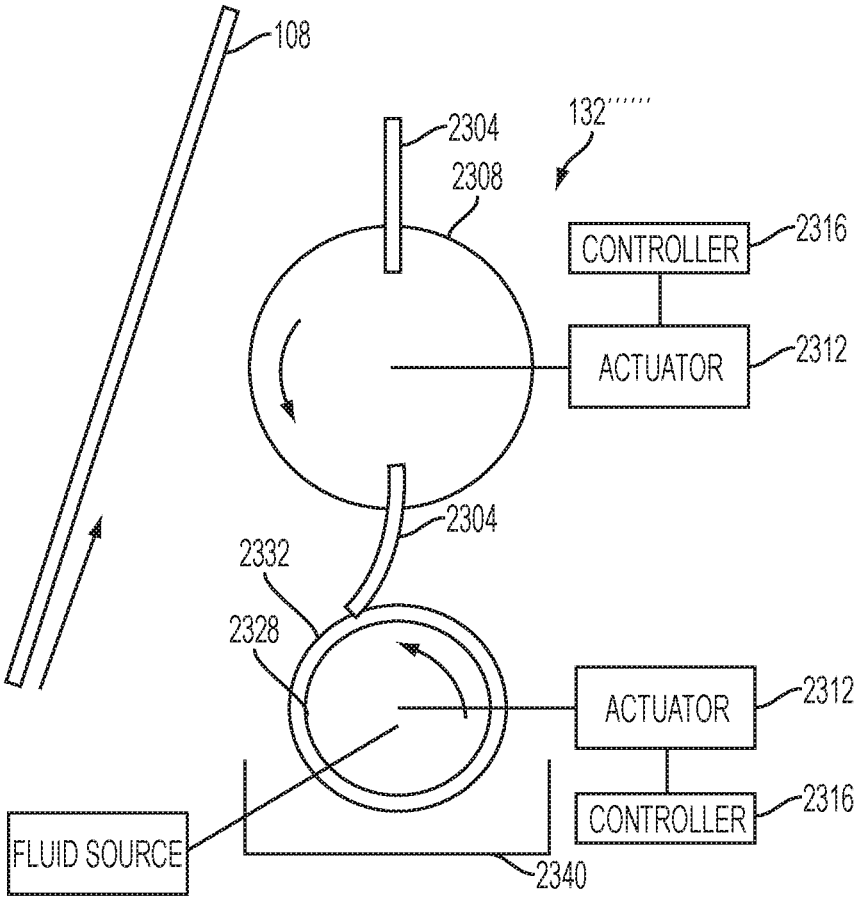
FIG. 24A and FIG. 24B show an alternative embodiment of a surface preparatory material remover depicted in FIG. 22.
Figure 24B:
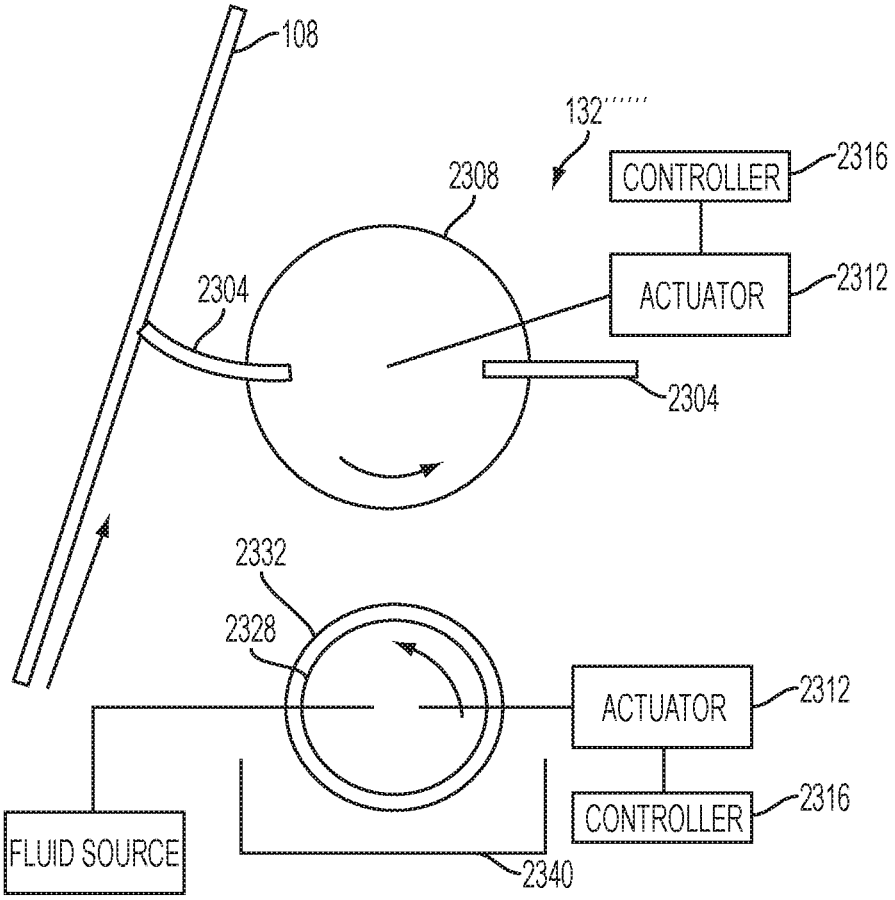

In another embodiment of the surface preparatory material remover 132"""" shown in FIG. 24A and FIG. 24 B, the pad or web 2324 is replaced by a roller 2328 covered with a foam material 2332. The interior volume of the roller 2328 is fluidly connected to a source of water or other solvent. The surface of the roller 2328 is perforated to enable the solvent to seep into the foam material as the source pumps solvent into the roller 2328. The water or solvent keeps the foam material 2332 moist and relatively clean. As the tips of the blades 2304 contact the foam material 2332 the roller rotates the foam material against the tips of the blades 2304 to remove surface preparatory material from the blade tips. Any excess water is captured by a tray 2340, which then flows into a drain line (not shown) for collection.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a printhead configured to eject liquid ink;

a rotating member positioned to rotate a surface of the rotating member past the printhead to enable the printhead to eject liquid ink towards the surface of the rotating member;

an applicator positioned with reference to the rotating member and printhead to apply a surface preparatory material to the surface of the rotating member and enable the ink ejected by the printhead to form an ink image on the surface preparatory material on the surface of the rotating member;

a first pad positioned to engage the surface preparatory material on the surface of the rotating member selectively to remove a portion of the surface preparatory material from the surface of the rotating member, the first pad being configured to move with reference to the rotating member to enable the first pad to engage the surface preparatory material on the surface of the rotating member selectively; and a controller operatively connected to the applicator, printhead and the first pad, the controller being configured to:

operate the applicator to apply a surface preparatory material to a surface of the rotating member;

operate the printhead to eject ink and form the ink image on the surface preparatory material on the surface of the rotating member;

receive an electrical signal identifying a type of media to which the ink image on the surface preparatory material on the surface of the rotating member is to be transferred; and operate the first pad to remove the portion of the surface preparatory material on the surface of the rotating member that is within an area in which the ink image is not located with reference to the signal identifying the type of media.

2. The printer of clam 1 wherein the applicator is a first roller.

3. The printer of claim 2 further comprising:

a second roller; and the controller being further configured to operate the first pad to move the first pad from engaging the surface preparatory material on the surface of the rotating member to a position where the first pad engages the second roller to enable the second roller to remove the surface preparatory material from the first pad that the first pad removed from the surface of the rotating member.

4. The printer of claim 3 further comprising:

a third roller to which the first pad is mounted, the third roller having a first end and a second end, the first pad extending between the first end and the second end of the third roller;

an actuator operatively connected to the third roller, the actuator being configured to rotate the third roller; and the controller being operatively connected to the actuator, the controller being further configured to operate the actuator to rotate the third roller and the first pad to enable the first pad to move between engaging the surface preparatory material on the surface of the rotating member and engaging the second roller that removes surface preparatory material from the first pad.

5. The printer of claim 4 further comprising:

at least one other roller, the at least one other roller being positioned proximate one of the first end and the second end of the third roller and the at least one other roller being configured to rotate independently of the third roller;

another pad mounted to the at least one other roller to extend between a first end and a second end of the at least one other roller;

at least one other actuator operatively connected to the at least one other roller, the at least one other actuator being configured to rotate the at least one other roller; and the controller being operatively connected to the at least one other actuator, the controller being further configured to operate the at least one other actuator to rotate the at least one other roller and engage with the other pad on the at least one other roller another portion of the surface preparatory material on the surface of the rotating member that is different than the portion of the surface preparatory material on the surface of the rotating member that is engaged by the first pad on the third roller to enable the other portion of the surface preparatory material on the surface of the rotating member to have a length that is different than a length of the portion of the surface preparatory material on the surface of the rotating member engaged by the first pad on the third roller.

6. The printer of claim 4 further comprising:

at least one other pad mounted to the third roller, the at least one other pad being longer than a length of the first pad with reference to a direction of rotation for the third roller and the first pad, a length of the at least one other pad and a length of the first pad together corresponding to a length between the first end and the second end of the third roller.

7. The printer of claim 4 further comprising:

at least one other pad mounted to the third roller at a position that is circumferentially offset from the first pad, the first pad and the at least one other pad being configured differently from each other to enable surface preparatory material to be removed from the surface of the rotating member in different patterns.

8. The printer of claim 3 further comprising:

a first elongated member having a first end and a second end, the first pad being mounted to the first end of the first elongated member;

an actuator operatively connected to the second end of the first elongated member; and the controller being operatively connected to the actuator, the controller being further configured to operate the actuator to move the first elongated member and the first pad selectively with reference to the surface preparatory material on the surface of the rotating member and the second roller that removes surface preparatory material from the first pad.

9. The printer of claim 8 further comprising:

at least one other elongated member, the at least one other elongated member being positioned proximate one of the first end and the second end of the first elongated member and the at least one other elongated member being configured to move independently of the first elongated member;

another pad mounted to the at least one other elongated member to extend between a first end and a second end of the at least one other elongated member;

at least one other actuator operatively connected to the at least one other elongated member, the at least one other actuator being configured to move the at least one other elongated member; and the controller being operatively connected to the at least one other actuator, the controller being further configured to operate the at least one other actuator to move the at least one other elongated member and engage with the other pad another portion of the surface preparatory material on the surface of the rotating member that is different than the portion of the surface preparatory material on the surface of the rotating member engaged by the first pad on the first elongated member to enable the other portion of the surface preparatory material on the surface of the rotating member to have a length that is different than a length of the portion of the surface preparatory material on the surface of the rotating member engaged by the first pad on the first elongated member.

10. The printer of claim 8 further comprising:

at least one other elongated member, the at least one other elongated member and the first elongated member being configured to engage the surface of the rotating member mutually exclusive of each other;

another pad mounted to the at least one other elongated member to extend between a first end and a second end of the at least one other elongated member, the other pad being configured differently from the first pad to enable the other pad to remove surface preparatory material from the surface of the rotating member with a pattern different than a pattern with which the first pad removes the material;

at least one other actuator operatively connected to the at least one other elongated member, the at least one other actuator being configured to move the at least one other elongated member; and the controller being operatively connected to the at least one other actuator, the controller being further configured to operate the at least one other actuator to move the at least one other elongated member and engage with the other pad another portion of the surface preparatory material on the surface of the rotating member that is different than the portion of the surface preparatory material on the surface of the rotating member engaged by the first pad on the first elongated member to enable the other portion of the surface preparatory material on the surface of the rotating member to have a length that is different than a length of the portion of the surface preparatory material on the surface of the rotating member engaged by the first pad on the first elongated member.

11. The printer of claim 1 wherein the first pad is tapered from a first end of the first pad towards a center of the first pad and from a second end of the first pad towards the center of the first pad to enable removal of surface preparatory material from outboard edges of the surface of the rotating member without removing surface preparatory material from a center portion of the surface of the rotating member.

12. A printer comprising:

a printhead configured to eject liquid ink;

a rotating member positioned to rotate a surface of the rotating member past the printhead to enable the printhead to eject liquid ink towards the surface of the rotating member;

a first roller positioned with reference to the rotating member and printhead to apply a surface preparatory material to the surface of the rotating member and enable the ink ejected by the printhead to form an ink image on the surface preparatory material on the surface of the rotating member;

a first pad positioned to engage the surface preparatory material on the surface of the rotating member to remove a portion of the surface preparatory material from the surface of the rotating member, the first pad being configured to move with reference to the rotating member to enable the first pad to engage the surface preparatory material on the surface of the rotating member selectively;

a second roller positioned with reference to the first pad to enable the second roller to engage the first pad; and a controller operatively connected to the first roller, the printhead and the first pad, the controller being configured to:

operate the first roller to apply a surface preparatory material to the surface of the rotating member;

operate the printhead to eject ink and form the ink image on the surface preparatory material on the surface of the rotating member;

operate the first pad to remove the portion of the surface preparatory material on the surface of the rotating member that is within an area in which the ink image is not located; and move the first pad from a position at which the first pad engages the surface preparatory material on the surface of the rotating member to a position at which the second roller engages the first pad to enable the second roller to remove the surface preparatory material from the first pad that the first pad removed from the surface of the rotating member.

13. The printer of claim 12 further comprising:

a third roller to which the first pad is mounted, the third roller having a first end and a second end, the first pad extending between the first end and the second end of the third roller;

an actuator operatively connected to the third roller, the actuator being configured to rotate the third roller; and the controller being operatively connected to the actuator, the controller being further configured to operate the actuator to rotate the third roller and the first pad to enable the first pad to move between engaging the surface preparatory material on the surface of the rotating member and engaging the second roller that removes surface preparatory material from the first pad.

14. The printer of claim 13 further comprising:

at least one other roller, the at least one other roller being positioned proximate one of the first end and the second end of the third roller and the at least one other roller being configured to rotate independently of the third roller;

another pad mounted to the at least one other roller to extend between a first end and a second end of the at least one other roller;

at least one other actuator operatively connected to the at least one other roller, the at least one other actuator being configured to rotate the at least one other roller; and the controller being operatively connected to the at least one other actuator, the controller being further configured to operate the at least one other actuator to rotate the at least one other roller and engage with the other pad on the at least one other roller another portion of the surface preparatory material on the surface of the rotating member that is different than the portion of the surface preparatory material on the surface of the rotating member that is engaged by the first pad on the third roller to enable the other portion of the surface preparatory material on the surface of the rotating member to have a length that is different than a length of the portion of the surface preparatory material on the surface of the rotating member engaged by the first pad on the third roller.

15. The printer of claim 13 further comprising:

at least one other pad mounted to the third roller, the at least one other pad being that a length of the first pad with reference to a direction of rotation for the third roller and the first pad, a length of the at least one other pad and a length of the first pad together corresponding to a length between the first end and the second end of the third roller.

16. The printer of claim 13 further comprising:

at least one other pad mounted to the third roller at a position that is circumferentially offset from the first pad, the first pad and the at least one other pad being configured differently from each other to enable surface preparatory material to be removed from the surface of the rotating member in different patterns.

17. The printer of claim 12 further comprising:

a first elongated member having a first end and a second end, the first pad being mounted to the first end of the first elongated member;

an actuator operatively connected to the second end of the first elongated member; and the controller being operatively connected to the actuator, the controller being further configured to operate the actuator to move the first elongated member and the first pad selectively with reference to the surface preparatory material on the surface of the rotating member and the second roller that removes surface preparatory material from the first pad.

18. The printer of claim 17 further comprising:

at least one other elongated member, the at least one other elongated member being positioned proximate one of the first end and the second end of the first elongated member and the at least one other elongated member being configured to move independently of the first elongated member;

another pad mounted to the at least one other elongated member to extend between a first end and a second end of the at least one other elongated member;

at least one other actuator operatively connected to the at least one other elongated member, the at least one other actuator being configured to move the at least one other elongated member; and the controller being operatively connected to the at least one other actuator, the controller being further configured to operate the at least one other actuator to move the at least one other elongated member and engage with the other pad another portion of the surface preparatory material on the surface of the rotating member that is different than the portion of the surface preparatory material on the surface of the rotating member engaged by the first pad on the first elongated member to enable the other portion of the surface preparatory material on the surface of the rotating member to have a length that is different than a length of the portion of the surface preparatory material on the surface of the rotating member engaged by the first pad on the first elongated member.

19. The printer of claim 17 further comprising:

at least one other elongated member, the at least one other elongated member and the first elongated member being configured to engage the surface of the rotating member mutually exclusive of each other;

another pad mounted to the at least one other elongated member to extend between a first end and a second end of the at least one other elongated member, the other pad being configured differently from the first pad to enable the other pad to remove surface preparatory material from the surface of the rotating member with a pattern different than a pattern with which the first pad removes the material;

at least one other actuator operatively connected to the at least one other elongated member, the at least one other actuator being configured to move the at least one other elongated member; and the controller being operatively connected to the at least one other actuator, the controller being further configured to operate the at least one other actuator to move the at least one other elongated member and engage with the other pad another portion of the surface preparatory material on the surface of the rotating member that is different than the portion of the surface preparatory material on the surface of the rotating member engaged by the first pad on the first elongated member to enable the other portion of the surface preparatory material on the surface of the rotating member to have a length that is different than a length of the portion of the surface preparatory material on the surface of the rotating member engaged by the first pad on the first elongated member.

20. The printer of claim 12 wherein the first pad is tapered from a first end of the first pad towards a center of the first pad and from a second end of the first pad towards the center of the first pad to enable removal of surface preparatory material from outboard edges of the surface of the rotating member without removing surface preparatory material from a center portion of the surface of the rotating member.

* * * * *